US011445874B2

(12) United States Patent
Conrad et al.

(10) Patent No.: US 11,445,874 B2
(45) Date of Patent: Sep. 20, 2022

(54) HAND CARRYABLE SURFACE CLEANING APPARATUS

(71) Applicant: Omachron Intellectual Property Inc., Hampton (CA)

(72) Inventors: Wayne Ernest Conrad, Hampton (CA); Daniel Innes, West Roxbury, MA (US)

(73) Assignee: Omachron Intellectual Property Inc., Hampton (CA)

( * ) Notice: Subject to any disclaimer, the term of this patent is extended or adjusted under 35 U.S.C. 154(b) by 339 days.

(21) Appl. No.: 16/872,094

(22) Filed: May 11, 2020

(65) Prior Publication Data

US 2020/0268224 A1 Aug. 27, 2020

Related U.S. Application Data

(63) Continuation of application No. 16/740,147, filed on Jan. 10, 2020, which is a continuation-in-part of (Continued)

(51) Int. Cl.
*A47L 5/24* (2006.01)
*A47L 5/28* (2006.01)

(Continued)

(52) U.S. Cl.
CPC ..... *A47L 5/24* (2013.01); *A47L 5/225* (2013.01); *A47L 5/28* (2013.01); *A47L 9/106* (2013.01);

(Continued)

(58) Field of Classification Search
CPC ..... A47L 5/24; A47L 5/225; A47L 5/28; A47L 9/106; A47L 9/122; A47L 9/165;

(Continued)

(56) References Cited

U.S. PATENT DOCUMENTS

| | | | |
|---|---|---|---|
| 6,625,845 | B2 | 9/2003 | Matsumoto et al. |
| 6,811,584 | B2 | 11/2004 | Oh |
| 6,824,580 | B2 | 11/2004 | Oh |
| 6,928,692 | B2 | 8/2005 | Oh et al. |
| 7,070,636 | B2 | 7/2006 | Mccormick et al. |

(Continued)

FOREIGN PATENT DOCUMENTS

| | | | |
|---|---|---|---|
| CN | 1679439 | B | 5/2010 |
| CN | 201719179 | U | 1/2011 |

(Continued)

OTHER PUBLICATIONS

International Search Report and the Written Opinion, received in connection to international patent application No. PCT/CA2021/050007, dated Mar. 12, 2021.

(Continued)

*Primary Examiner* — David Redding
(74) *Attorney, Agent, or Firm* — Philip C. Mendes da Costa; Bereskin & Parr LLP/S.E.N.C.R.L., s.r.l.

(57) ABSTRACT

A hand vacuum cleaner has an air treatment member positioned in an air flow path through the hand vacuum cleaner. The air treatment member comprises an air treatment chamber and a dirt collection chamber exterior to the air treatment chamber. The air treatment member comprises a stationary portion and an openable portion, the openable portion comprises a portion of a sidewall of the air treatment chamber and the openable portion is moveably mounted by a mount between a closed position in which the air treatment chamber and the dirt collection chamber are closed and an open position in which the air treatment chamber and the dirt collection chamber are open. When the inlet conduit extends generally horizontally, the dirt collection chamber underlies the air treatment chamber.

20 Claims, 36 Drawing Sheets

Related U.S. Application Data application No. 16/440,590, filed on Jun. 13, 2019, which is a continuation-in-part of application No. 16/270,693, filed on Feb. 8, 2019, now Pat. No. 11,202,539, and a continuation-in-part of application No. 16/156,006, filed on Oct. 10, 2018, now Pat. No. 10,478,030, said application No. 16/270,693 is a continuation of application No. 15/905,941, filed on Apr. 11, 2016, now Pat. No. 10,258,208, said application No. 16/156,006 is a continuation of application No. 15/088,876, filed on Apr. 1, 2016, now Pat. No. 10,219,662, which is a continuation of application No. 14/822,211, filed on Aug. 10, 2015, now Pat. No. 9,888,817.

(60) Provisional application No. 62/093,189, filed on Dec. 17, 2014.

(51) Int. Cl.

| | |
|---|---|
| ***A47L 9/32*** | (2006.01) |
| ***A47L 9/16*** | (2006.01) |
| ***A47L 9/10*** | (2006.01) |
| ***A47L 9/22*** | (2006.01) |
| ***A47L 5/22*** | (2006.01) |
| ***A47L 9/28*** | (2006.01) |
| ***A47L 9/12*** | (2006.01) |

(52) U.S. Cl.

CPC ..... *A47L 9/122* (2013.01); *A47L 9/165* (2013.01); *A47L 9/1666* (2013.01); *A47L 9/1683* (2013.01); *A47L 9/1691* (2013.01); *A47L 9/22* (2013.01); *A47L 9/2868* (2013.01); *A47L 9/322* (2013.01)

(58) Field of Classification Search

CPC .... A47L 9/1666; A47L 9/1683; A47L 9/1691; A47L 9/22; A47L 9/2868; A47L 9/322; A47L 9/125; A47L 9/1608; A47L 9/1675; A47L 9/20

See application file for complete search history.

(56) References Cited

U.S. PATENT DOCUMENTS

| | | | |
|---|---|---|---|
| 7,074,248 | B2 | 7/2006 | Jin et al. |
| 7,152,276 | B2 | 12/2006 | Jin et al. |
| 7,152,277 | B2 | 12/2006 | Jung et al. |
| 7,318,249 | B2 | 1/2008 | Lin |
| 7,318,848 | B2 | 1/2008 | Lee |
| 7,351,269 | B2 | 4/2008 | Yau |
| 7,412,749 | B2 | 8/2008 | Thomas et al. |
| 7,419,520 | B2 | 9/2008 | Lee et al. |
| 7,494,520 | B2 | 2/2009 | Nam et al. |
| 7,611,553 | B2 | 11/2009 | Hato |
| 7,704,290 | B2 | 4/2010 | Oh |
| 7,803,207 | B2 | 9/2010 | Conrad |
| 7,882,593 | B2 | 2/2011 | Beskow et al. |
| 7,958,597 | B2 | 6/2011 | Frantzen et al. |
| 3,029,590 | A1 | 10/2011 | Cheng |
| 8,069,529 | B2 | 12/2011 | Groff et al. |
| 8,156,609 | B2 | 4/2012 | Milne et al. |
| 8,424,154 | B2 | 4/2013 | Beskow et al. |
| 8,549,704 | B2 | 10/2013 | Milligan et al. |
| 8,567,008 | B2 | 10/2013 | Conrad |
| 8,591,615 | B2 | 11/2013 | Kim et al. |
| 8,607,406 | B2 | 12/2013 | Miefalk et al. |
| 8,607,407 | B2 | 12/2013 | Conrad |
| 8,640,304 | B2 | 2/2014 | Conrad |
| 8,763,201 | B2 | 7/2014 | Kim et al. |
| 8,769,764 | B2 | 7/2014 | Crouch et al. |
| 8,870,988 | B2 | 10/2014 | Oh et al. |
| 8,926,723 | B2 | 1/2015 | Kim |
| 8,951,319 | B2 | 2/2015 | Kim et al. |
| 9,591,952 | B2 | 3/2017 | Conrad |
| 2003/0159235 | A1 | 8/2003 | Oh |
| 2004/0163206 | A1 | 8/2004 | Oh |
| 2006/0090290 | A1 | 5/2006 | Lau |
| 2007/0226948 | A1 | 10/2007 | Due |
| 2009/0151306 | A1 | 6/2009 | Lin |
| 2009/0183633 | A1 | 7/2009 | Schiller et al. |
| 2009/0223183 | A1 | 9/2009 | Lin |
| 2009/0229230 | A1 | 9/2009 | Cheng |
| 2011/0289720 | A1 | 12/2011 | Han et al. |
| 2014/0366310 | A1 | 12/2014 | Conrad |
| 2017/0209011 | A1 | 7/2017 | Robinson et al. |
| 2017/0319033 | A1 | 11/2017 | Hyun et al. |
| 2019/0200825 | A1 | 7/2019 | Crouch et al. |

FOREIGN PATENT DOCUMENTS

| | | | |
|---|---|---|---|
| CN | 101984910 | A | 3/2011 |
| CN | 201840420 | U | 5/2011 |
| CN | 102125407 | A | 7/2011 |
| CN | 203852305 | U | 10/2014 |
| CN | 105078367 | B | 8/2017 |
| CN | 107468159 | A | 12/2017 |
| DE | 19704468 | A1 | 8/1998 |
| DE | 20311505 | U1 | 10/2003 |
| DE | 102007059591 | A1 | 6/2009 |
| DE | 102013108564 | A1 | 3/2015 |
| EP | 1535564 | B1 | 8/2009 |
| EP | 1743562 | B1 | 9/2011 |
| EP | 1959809 | B1 | 5/2014 |
| EP | 2459043 | B1 | 9/2015 |
| EP | 2225993 | B1 | 2/2016 |
| GB | 2370006 | B | 10/2003 |
| GB | 2449484 | B | 4/2009 |
| GB | 2459300 | B | 3/2010 |
| GB | 2487387 | B | 9/2015 |
| JP | 2003038398 | A | 2/2003 |
| JP | 2003339593 | A | 12/2003 |
| JP | 2003339594 | A | 12/2003 |
| JP | 2003339595 | A | 12/2003 |
| JP | 2003339596 | A | 12/2003 |
| JP | 2005218512 | A | 8/2005 |
| JP | 3699679 | B2 | 9/2005 |
| JP | 2006340935 | A | 12/2006 |
| JP | 2007089755 | A | 4/2007 |
| JP | 2008035887 | A | 2/2008 |
| JP | 4070638 | B2 | 4/2008 |
| JP | 2008154801 | A | 7/2008 |
| JP | 2008194177 | A | 8/2008 |
| JP | 2008246154 | A | 10/2008 |
| JP | 4208742 | B2 | 1/2009 |
| JP | 4231808 | B2 | 3/2009 |
| JP | 4977264 | B2 | 7/2012 |
| JP | 5070322 | B2 | 11/2012 |
| JP | 5177814 | B2 | 4/2013 |
| JP | 5330909 | B2 | 10/2013 |
| JP | 5724218 | B2 | 5/2015 |
| JP | 6072502 | B2 | 2/2017 |
| JP | 6088784 | B2 | 3/2017 |
| KR | 100572866 | B1 | 4/2006 |
| KR | 100572877 | B1 | 4/2006 |
| KR | 100634805 | B1 | 10/2006 |
| KR | 100880492 | B1 | 1/2009 |
| KR | 101134243 | B1 | 3/2012 |
| KR | 101306738 | B1 | 9/2013 |
| KR | 101770755 | B1 | 8/2017 |
| WO | 2011025071 | A1 | 3/2011 |
| WO | 2016206759 | A1 | 12/2016 |
| WO | 2018119510 | A1 | 7/2018 |
| WO | 2019030481 | A1 | 2/2019 |

OTHER PUBLICATIONS

"Lupe Cordless Vacuum Cleaner. Powerful. Enduring. Flexible." retrieved at https://www.kickstarter.com/projects/lupepablo/lupe-cordless-vacuum-cleaner-powerful-enduring-flexible; published at least as early as Jun. 18, 2019.

(56) References Cited

OTHER PUBLICATIONS

English machine translation of CN203852305U, published on Oct. 1, 2014.
English machine translation of CN201840420U, published on May 25, 2011.
English machine translation of CN201719179U, published on Jan. 26, 2011.
English machine translation of CN107468159A, published on Dec. 15, 2017.
English machine translation of CN105078367B, published on Aug. 25, 2017.
English machine translation of CN102125407A, published on Jul. 20, 2011.
English machine translation of CN101984910A, published on Mar. 16, 2011.
English machine translation of CN1679439B, published on May 26, 2010.
English machine translation of DE102013108564A1, published on Mar. 5, 2015.
English machine translation of DE102007059591A1, published on Jun. 18, 2009.
English machine translation of DE20311505111, published on Oct. 30, 2003.
English machine translation of DE19704468A1, published on Aug. 13, 1998.
English machine translation of EP2459043B1, published on Sep. 16, 2015.
English machine translation of EP1959809B1, published on May 21, 2014.
English machine translation of EP1535564B1, published on Aug. 19, 2009.
English machine translation of JP5330909B2, published on Oct. 30, 2013.
English machine translation of JP5724218B2, published on May 27, 2015.
English machine translation of JP2008246154A, published on Oct. 16, 2008.
English machine translation of JP2008194177A, published on Aug. 28, 2008.
English machine translation of JP2008154801A, published on Jul. 10, 2008.
English machine translation of JP2008035887A, published on Feb. 21, 2008.
English machine translation of JP2007089755A, published on Apr. 12, 2007.
English machine translation of JP2006340935A, published on Dec. 21, 2006.
English machine translation of JP2005218512A, published on Aug. 18, 2005.
English machine translation of JP2003339596A, published on Dec. 2, 2003.
English machine translation of JP2003339595A, published on Dec. 2, 2003.
English machine translation of JP2003339594A, published on Dec. 2, 2003.
English machine translation of JP2003339593A, published on Dec. 2, 2003.
English machine translation of JP2003038398A, published on Dec. 2, 2003.
English machine translation of JP6088784B2, published on Mar. 1, 2017.
English machine translation of JP6072502B2 , published on Feb. 1, 2017.
English machine translation of JP3699679B2, published on Sep. 28, 2005.
English machine translation of JP4070638B2, published on Apr. 2, 2008.
English machine translation of JP4208742B2, published on Jan. 14, 2009.
English machine translation of JP4231808B2, published on Mar. 4, 2009.
English machine translation of JP4977264B2, published on Jul. 18, 2012.
English machine translation of JP5070322B2, published on Nov. 14, 2012.
English machine translation of JP5177814B2, published on Apr. 10, 2013.
English machine translation of KR101770755B1, published on Aug. 23, 2017.
English machine translation of KR101306738B1, published on Sep. 4, 2013.
English machine translation of KR101134243B1, published on Mar. 30, 2012.
English machine translation of KR100880492B1, published on Jan. 19, 2009.
English machine translation of KR100634805B1, published on Oct. 10, 2006.
English machine translation of KR100572877B1, published on Apr. 14, 2006.
English machine translation of KR100572866B1, published on Apr. 14, 2006.
English machine translation of WO2011025071A1, published on Mar. 3, 2011.

HAND CARRYABLE SURFACE CLEANING APPARATUS

CROSS REFERENCE TO RELATED APPLICATIONS

This application is a continuation of the U.S. patent application Ser. No. 16/740,147, filed on Jan. 10, 2020, which itself is a continuation-in-part of U.S. patent application Ser. No. 16/440,590, filed on Jun. 13, 2019, which is a continuation-in-part of U.S. patent application Ser. No. 16/270,693, filed on Feb. 8, 2019 which is a continuation of U.S. patent application Ser. No. 15/095,941, filed on Apr. 11, 2016, now issued as U.S. Pat. No. 10,258,208, and is a continuation-in-part of U.S. patent application Ser. No. 16/156,006 filed on Oct. 10, 2018, now issued as U.S. Pat. No. 10,478,030, which is a continuation of U.S. patent application Ser. No. 15/088,876 filed on Apr. 1, 2016, now issued as U.S. Pat. No. 10,219,662, which is a continuation of U.S. patent application Ser. No. 14/822,211, filed Aug. 10, 2015, now issued as U.S. Pat. No. 9,888,817, which claimed priority from U.S. Provisional Patent Application No. 62/093,189, filed Dec. 17, 2014, the entirety of each which are hereby incorporated by reference.

FIELD

This disclosure relates generally to surface cleaning apparatus. In a preferred embodiment, the surface cleaning apparatus comprises a portable surface cleaning apparatus, such as a hand vacuum cleaner.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carryable surface cleaning apparatus such as hand vacuums. Further, various designs for cyclonic hand vacuum cleaners, including battery operated cyclonic hand vacuum cleaners, are known in the art.

Surface cleaning apparatus may use a cyclone to separate particulate matter from an air stream. Typically, a cyclone may have a porous member such as a screen or filter positioned such that air flows through the porous member as the air exits the cyclone chamber. Particulate matter may accumulate on the exterior surface of the porous member during use of the surface cleaning apparatus. Accordingly, the porous member may require occasional cleaning to remove the particulate matter on its outer surface.

SUMMARY

This summary is intended to introduce the reader to the more detailed description that follows and not to limit or define any claimed or as yet unclaimed invention. One or more inventions may reside in any combination or subcombination of the elements or process steps disclosed in any part of this document including its claims and figures.

In accordance with one broad aspect of this disclosure, which may be used by itself or any other aspect set out herein, a surface cleaning apparatus, such as a hand vacuum cleaner, is provided having an air treatment member, such as a cyclone, wherein a porous member is provided such that air passes through the porous member as the air exists the air treatment chamber. A member is provided that moves to facilitate the removal of particulate matter that has accumulated on an outer surface of the porous member. For example, a portion of the sidewall of the air treatment member may move longitudinally to expose or better expose the porous member to facilitate the removal of particulate matter that has accumulated on an outer surface of the porous member. Alternately, or in addition, a cleaning member may travel longitudinally along part or all of the porous member. Alternately, or in addition, the porous member may be moved, e.g., longitudinally. Optionally, one or more biasing mechanisms (e.g., biasing springs) are provided to automatically translate the moveable member between an operating position of the moveable member (the position of the moveable member when the hand vacuum cleaner is in use) and the cleaning position (the position of the moveable member after the moveable member has been translated longitudinally), without manual intervention of a user.

In accordance with this broad aspect, there is provided a hand vacuum cleaner comprising:

(a) an air flow path extending from a dirty air inlet to a clean air outlet;

(b) a main body having the dirty air inlet, a suction motor positioned in the air flow path upstream of the clean air outlet and a handle;

(c) a cyclone positioned in the air flow path, the cyclone comprising a cyclone chamber, a cyclone chamber air inlet, a cyclone chamber air outlet, a centrally positioned cyclone axis of rotation, a first end having the cyclone chamber air outlet, an axially spaced apart second end and an axially extending sidewall extending between the first and second ends, wherein the cyclone chamber air outlet comprises a generally axially extending porous member having a porous sidewall and wherein a portion of the axially extending sidewall is rotatably mounted between a closed position in which the cyclone chamber is closed and an open position in which the cyclone chamber is open; and, (d) a moveable member comprising at least one of the portion of the axially extending sidewall, the porous member and, a cleaning member positioned in the cyclone chamber between the axially extending sidewall of the cyclone chamber and the porous sidewall, wherein the moveable member is moveable from an operating position in which the moveable member is positioned towards the first end and a cleaning position in which the moveable member has been translated axially away from the first end, wherein, the moveable member is moveable as or subsequent to the portion of axially extending sidewall of the cyclone chamber being moved away from the closed position.

In some embodiments, the moveable member may be moveable from the operating position towards the cleaning position as the portion of axially extending sidewall of the cyclone chamber is moved from the closed position towards the open position.

In some embodiments, the moveable member may be biased towards the cleaning position.

In some embodiments, the moveable member may be moveable from the operating position to the cleaning position when the portion of axially extending sidewall of the cyclone chamber is in the open position.

In some embodiments, the hand vacuum cleaner may further comprise an actuator that is drivingly connected to the moveable member.

In some embodiments, the portion of axially extending sidewall may be rotatably mounted by a rotatable mount and the rotatable mount may be located at the first end of the cyclone.

In some embodiments, the portion of axially extending sidewall may be pivotally mounted to the main body about an axis that is transverse to the cyclone axis of rotation.

In some embodiments, the moveable member may comprise at least one of the portion of the axially extending sidewall and the cleaning member, and in the cleaning position, at least a portion of the moveable member may be positioned axially outwardly for the first end of the cyclone.

In some embodiments, the moveable member may be telescopically mounted.

In some embodiments, the moveable member may comprise the cleaning member wherein, in the operating position, the cleaning member abuts the first end and, in the cleaning position, at least a portion of the cleaning member has been translated axially away from the first end.

In some embodiments, the cleaning member may comprise an annular member.

In some embodiments, the moveable member may comprise the porous member and in the cleaning position, the porous member has been axially translated away from the first end.

In some embodiments, in the cleaning position, at least a portion of the porous member may be positioned axially outwardly of the first end of the cyclone.

In some embodiments, the moveable member may comprise the portion of the axially extending sidewall and the cleaning member.

In some embodiments, the moveable member may comprise the axially extending portion of the sidewall.

In some embodiments, the porous member may be tapered towards the second end.

In accordance with this broad aspect of this disclosure there is also provided a hand vacuum cleaner comprising:

(a) an air flow path extending from a dirty air inlet to a clean air outlet;

(b) an air treatment member having an air treatment chamber positioned in the air flow path, the air treatment member comprising an air treatment chamber, an air treatment chamber air inlet, an air treatment chamber air outlet, a first end having the air treatment chamber air outlet, a second end longitudinally spaced apart in a longitudinal direction and a longitudinally extending sidewall, wherein the air treatment chamber air outlet comprises a longitudinally extending porous member having a longitudinally extending porous sidewall;

(c) a suction motor positioned in the air flow path upstream of the clean air outlet;

(d) a moveable member positioned in the air treatment chamber, the moveable member comprising at least one of a portion of the air treatment member sidewall, the porous member and a cleaning member positioned in the air treatment chamber between the air treatment chamber sidewall and the porous sidewall; and, wherein, the moveable member is moveable as or subsequent to the portion of the air treatment member sidewall being moved away from the closed position.

In some embodiments, the moveable member may comprise at least one of the portion of the air treatment member sidewall and the cleaning member, and in the cleaning position, at least a portion of the moveable member is positioned longitudinally outwardly from the second end of the cyclone.

In some embodiments, the moveable member may be telescopically mounted.

In some embodiments, the portion of the air treatment member sidewall may be pivotally mounted about an axis that is transverse to the longitudinal direction.

BRIEF DESCRIPTION OF THE DRAWINGS

For a better understanding of the described embodiments and to show more clearly how they may be carried into effect, reference will now be made, by way of example, to the accompanying drawings in which.

DESCRIPTION OF EXAMPLE EMBODIMENTS

Figure 1:
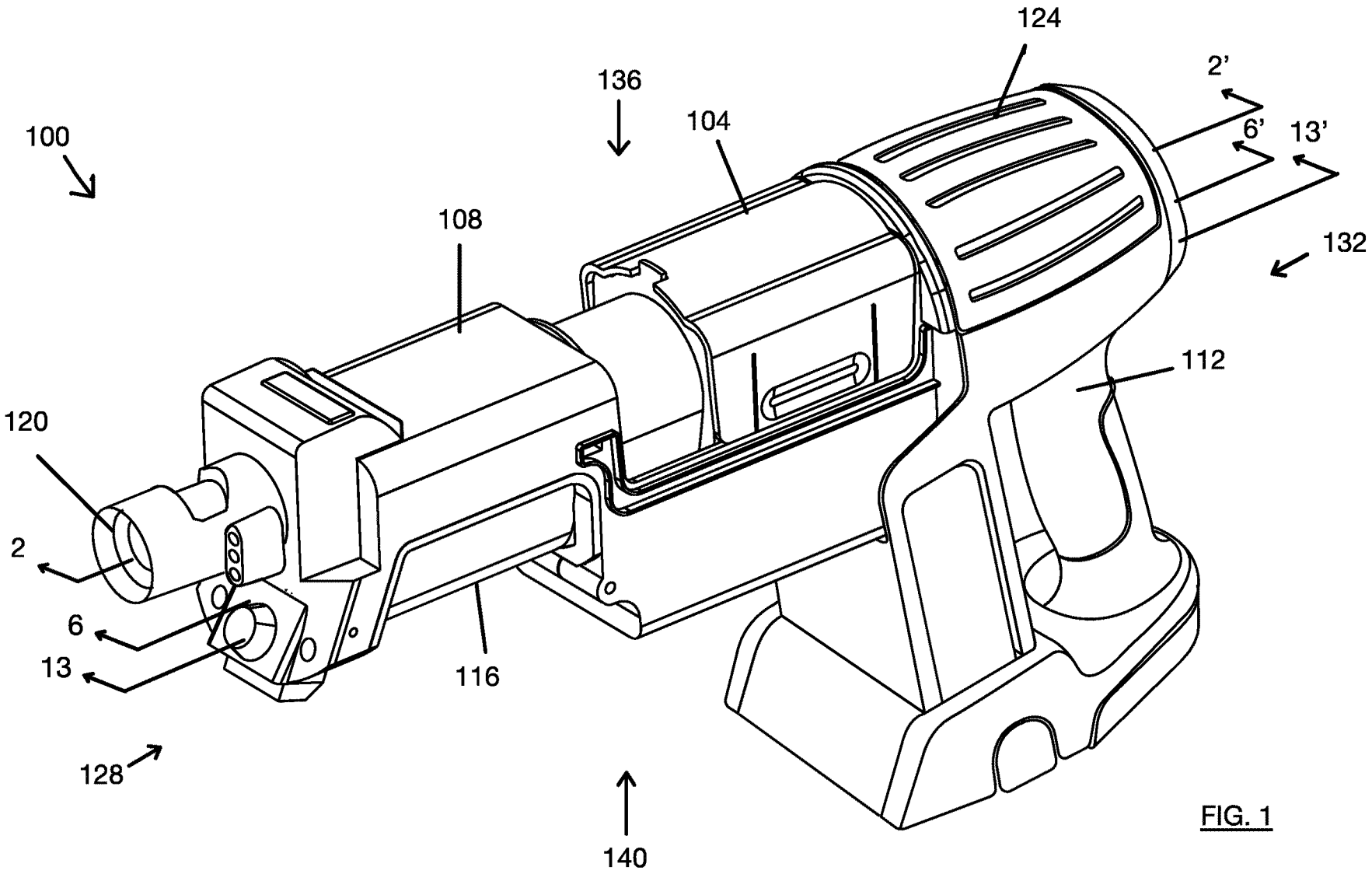
FIG. 1 is a perspective view of a hand vacuum cleaner in accordance with one embodiment.

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

As used herein and in the claims, two elements are said to be "parallel" where those elements are parallel and spaced apart, or where those elements are collinear.

Some elements herein may be identified by a part number, which is composed of a base number followed by an alphabetical or subscript-numerical suffix (e.g. 112*a*, or $\mathbf{112}_1$). Multiple elements herein may be identified by part numbers that share a base number in common and that differ by their suffixes (e.g. $\mathbf{112}_1$,$\mathbf{112}_2$, and $\mathbf{112}_3$). All elements with a common base number may be referred to collectively or generically using the base number without a suffix (e.g. 112).

General Description of a Hand Vacuum Cleaner

Figure 2:
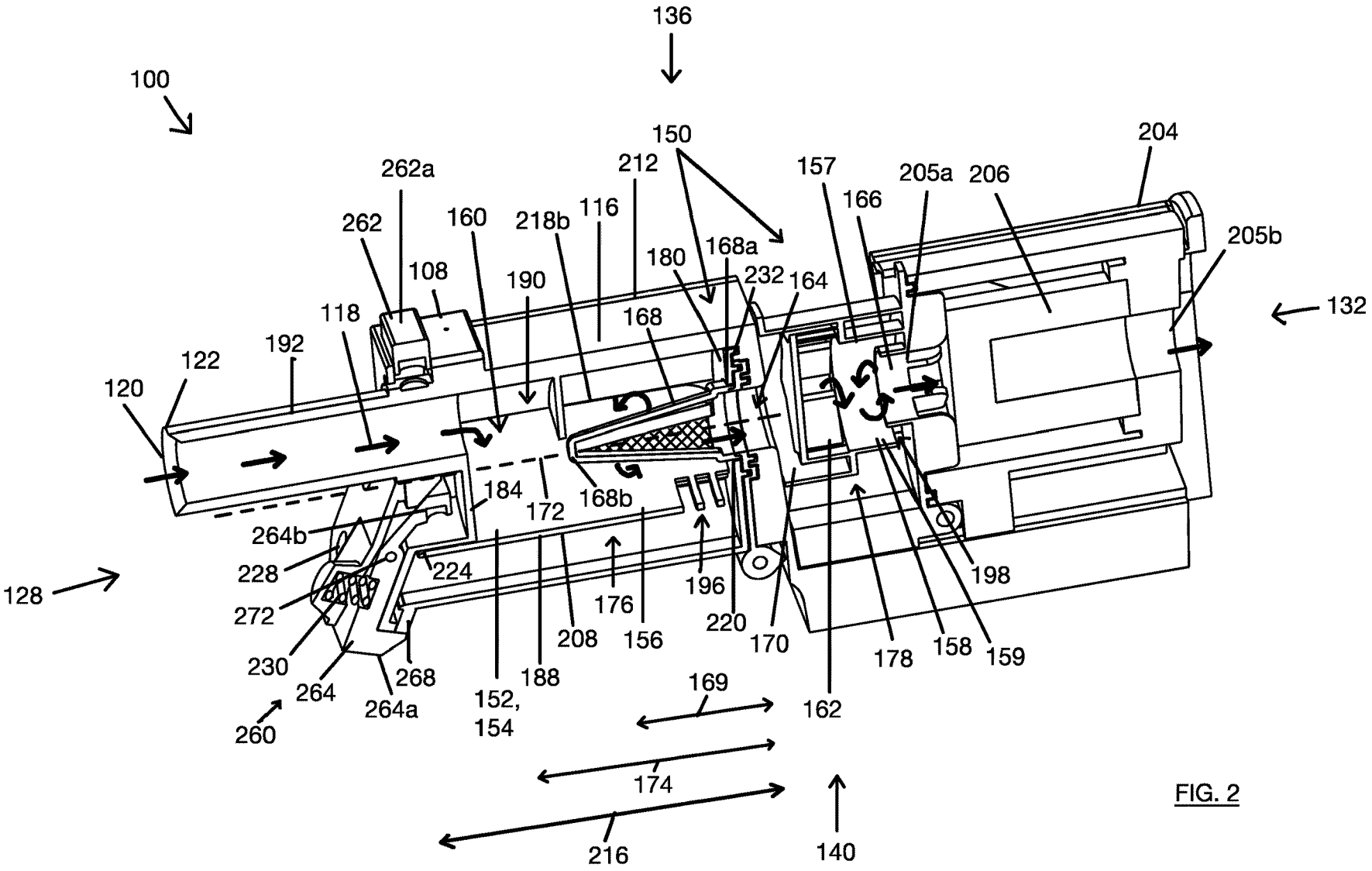
FIG. 2 is a perspective cross-sectional view of a portion of the hand vacuum cleaner, taken along section line 2-2' of FIG. 1.

Referring now to FIGS. 1-2, the following is a general discussion of embodiments of an apparatus 100, which provides a basis for understanding several of the features that are discussed herein. As discussed subsequently, each of the features may be used individually or in any particular combination or sub-combination in these or in other embodiments disclosed herein.

In the illustrated embodiment, the surface cleaning apparatus 100 is a hand vacuum cleaner, which may also be referred to as a "handvac" or "hand-held vacuum cleaner". As used herein, a hand vacuum cleaner is a vacuum cleaner that can be operated to clean a surface generally one-handedly. That is, the entire weight of the vacuum may be held by the same one hand used to direct a dirty air inlet of the vacuum cleaner with respect to a surface to be cleaned. For example, the handle and a clean air inlet may be rigidly coupled to each other (directly or indirectly) so as to move as one while maintaining a constant orientation relative to each other. This is to be contrasted with canister and upright vacuum cleaners, whose weight is typically supported by a surface (e.g. a floor) during use. It will be appreciated that, in other embodiments, the porous member (screen or filter) disclosed herein may be used in any surface cleaning apparatus.

As exemplified in FIGS. 1 and 2, the hand vacuum cleaner 100 includes a main body 104. The main body 104 includes a housing 108, a handle 112, an air treatment member 116 connected to the main body 104, a dirty air inlet 120, a clean air outlet 124, and an air flow path 118 (FIG. 2) extending between the dirty air inlet 120 and the clean air outlet 124.

Hand vacuum cleaner 100 also has a front end 128, a rear end 132, an upper end 136 (also referred to as the top end, or upper portion), and a lower end 140 (also referred to as the bottom end, or lower portion). As exemplified in the embodiment shown in FIGS. 1 and 2, dirty air inlet 120 may be located at an upper portion of the front end 128, and clean air outlet 124 may be located at an upper portion of the rear end 132. In other embodiments, however, the dirty air inlet 120 and the clean air outlet 124 may be provided at different locations on the housing body 108.

As best exemplified in FIG. 2, the dirty air inlet 120 may comprise an inlet end 122 of an air inlet conduit 192. Optionally, the inlet end 122 can be used as a nozzle for cleaning a surface. Alternatively, or in addition, the inlet end 122 can be connected, directly or in-directly, to a downstream end of any suitable cleaning accessory tool. For example, the inlet end 122 can be connected to a rigid air flow conduit (e.g., an above floor cleaning wand), a crevice tool, a mini brush, etc.

Air treatment member 116 is configured to remove particles of dirt and other debris from the air flow. In the illustrated example, air treatment member 116 comprises a cyclone assembly 150 (also referred to as a "cyclone bin assembly") having at least a first cyclonic cleaning stage 152 with a single cyclone 154. Optionally, as exemplified in the embodiment of FIG. 2, the cyclone assembly 150 may also include a second cyclonic cleaning stage 158 with a single cyclone 159. The second cyclonic cleaning stage 158 may be positioned downstream from the first cyclonic cleaning stage 152 and may comprise a plurality of cyclones.

As exemplified, the first cyclonic stage 152 may comprise a cyclone chamber 156 (e.g., the interior of the cyclone 154) and a dirt collection chamber 176 (also referred to as a "dirt collection region", "dirt collection bin", "dirt bin", or "dirt chamber"). Similarly, the second cyclonic stage 158 may comprise a cyclone chamber 157, and a dirt collection chamber 178. In the exemplified embodiments, each of the dirt collection chambers 176, 178 is positioned external to the respective cyclone chamber 156, 157, in the sense that the dirt chambers have a discrete volume from that of cyclone chambers. In other cases, the dirt collection chamber of one or more of the cyclone chambers 156, 157 may be a dirt collection region located partially or entirely within a volume of respective cyclone chamber.

While the exemplified embodiments illustrate two cyclonic stages arranged in series, in other embodiments, the cyclone assembly 150 may include one cyclonic stage, or more than two cyclonic stages. The cyclone stages may be arranged in any suitable configuration with respect to other cyclone stages. Further, each cyclone stage may include one or more cyclone chambers (arranged in parallel with each other) and one or more dirt collection chambers, of any suitable configuration. The dirt collection chambers may be separate, or may be shared in common between the one or more cyclone chambers.

As exemplified, cyclone chamber 156, of the first cyclone stage 152, extends along a cyclone axis 172 between a first cyclone end wall 180 (also referred to herein as a "first cyclone end"), and an axially opposed second cyclone end wall 184 (also referred to herein as a "second cyclone end"). A cyclone sidewall 188 extends axially between the first cyclone end 180 and the second cyclone end 184. Cyclone 154 also includes a cyclone air inlet 160 and a cyclone air outlet 164. In the exemplified embodiments, the cyclone 154 is configured as a uniflow cyclone, in the sense that air may enter from one end of the cyclone chamber and exit from another end of the cyclone chamber. As exemplified, the cyclone air inlet 160 may be located proximal the second cyclone end 184, while the cyclone air outlet 164 may be located at the first cyclone end wall 180. In other embodiments, the cyclone air inlet 160 and cyclone air outlet 164 may be positioned at any other suitable location (e.g., at the same cyclone end).

The cyclone air inlet 160 and cyclone air outlet 164 may have any design known in the art. As exemplified, the cyclone air inlet 160 may comprise a tangential inlet terminating at a port (e.g., opening) 190. Further, the cyclone air outlet 162 may comprise an opening (e.g., an aperture) in the first cyclone end 180. In some embodiments, a porous member 168 (e.g. a fine mesh screen or a filter having a porous sidewall), may cover the cyclone air outlet 164. The screen 168 may be positioned in the air flow path 118 to remove large dirt particles and debris, such as hair, remaining in the exiting air flow. As exemplified, the screen 168 can extend along cyclone axis 172 by any suitable length between a first end 168*a* and an axially opposed second end 168*b*. In the exemplified case, the first end 168*a* is located at the first cyclone end 180, while the second end 168*b* is located more proximal to the second cyclone end 184. The screen or shroud 168 may also have any appropriate shape. For instance, in the illustrated example, screen 168 has a conical shape, which is defined by a tapering structure from the first end 168*a* toward the second end 168*b*. In other embodiments, screen 168 may have, e.g., a frusto-conical shape or a cylindrical shape.

As exemplified, when the upper end 136 of the hand vacuum 100 is positioned over the lower end 140, cyclone axis 172 is oriented generally horizontally. In other cases, however, cyclone axis 172 may be offset by any angle from the horizontal plane (e.g., ±5°, ±10°, ±15°, ±20° offset from the horizontal). Cyclone axis 172 can also be oriented generally vertically, or at an angle to the vertical.

As air circulates inside of cyclone chamber 156, dirt may be ejected from the cyclone chamber 156 into the external dirt collection chamber 176, via dirt outlet 196. Dirt outlet 196 can have any one of a number of variable designs. For instance, as exemplified, the dirt outlet 196 may comprise one or more openings (e.g., slots or perforations) in the cyclone sidewall 188. The dirt outlet 196 may also be positioned at any location within the cyclone 154. In the illustrated embodiment, the dirt outlet 196 is positioned at a lower, rearward portion of the sidewall 188. An advantage of this configuration is that dirt outlet 196 faces downwardly into the dirt collection chamber 176. Accordingly, dirt may enter from a top portion of the dirt collection chamber 176, and collect and aggregate inside of the dirt chamber 176. In the exemplified embodiment, the dirt outlet 196 is provided near the first cyclone end 180. However, in other cases, the dirt outlet 196 may also be positioned, for example, at a mid-point of the cyclone 154, or proximal second cyclone end 184.

A suction motor 144 generates a vacuum suction through the air flow path. As best exemplified by FIG. 3, the suction motor 144 may be positioned within a motor housing 148 rearward of the air treatment member 166. As exemplified, the suction motor 144 may be positioned downstream from the air treatment member 116, and upstream of the hand vac air outlet 124 and handle 112. However, in alternative embodiments, suction motor 144 may be positioned upstream of the air treatment member 116 (e.g. a dirty air motor). Optionally, as exemplified, the hand vacuum 100 may also include one or more energy storage members 207 (e.g., batteries 207) to supply power to the suction motor 144.

In operation, the suction motor 144 is activated to draw dirty air into the hand vacuum 100 through the dirty air inlet 120. Air flow may be directed from the dirty air inlet 120, along the air inlet conduit 192, into the first stage cyclone 152 via cyclone air inlet 160 (e.g., inlet port 190). As dirty air flow enters and cyclones inside of cyclone chamber 156, dirt particles and other debris can be dis-entrained, or separated, from the air flow. Dirt particles and debris, which are separated from the air flo'w, may be discharged into the dirt collection chamber 176, via dirt outlet 196. Air may then exit the cyclone 154, through the cyclone air outlet 164, and into an outlet passage 170. The outlet passage 170 may direct air flow into the second stage cyclone 158. In the exemplified embodiment, air may enter the second stage cyclone 159 through one or more air inlets 162. Inside of the cyclone chamber 157, air may circulate, and may exit through air outlet 166. Dirt dis-entrained from the cyclonic air flow inside cyclone 158 may be ejected into the external dirt collection chamber 178, via dirt outlet 198.

Figure 3:
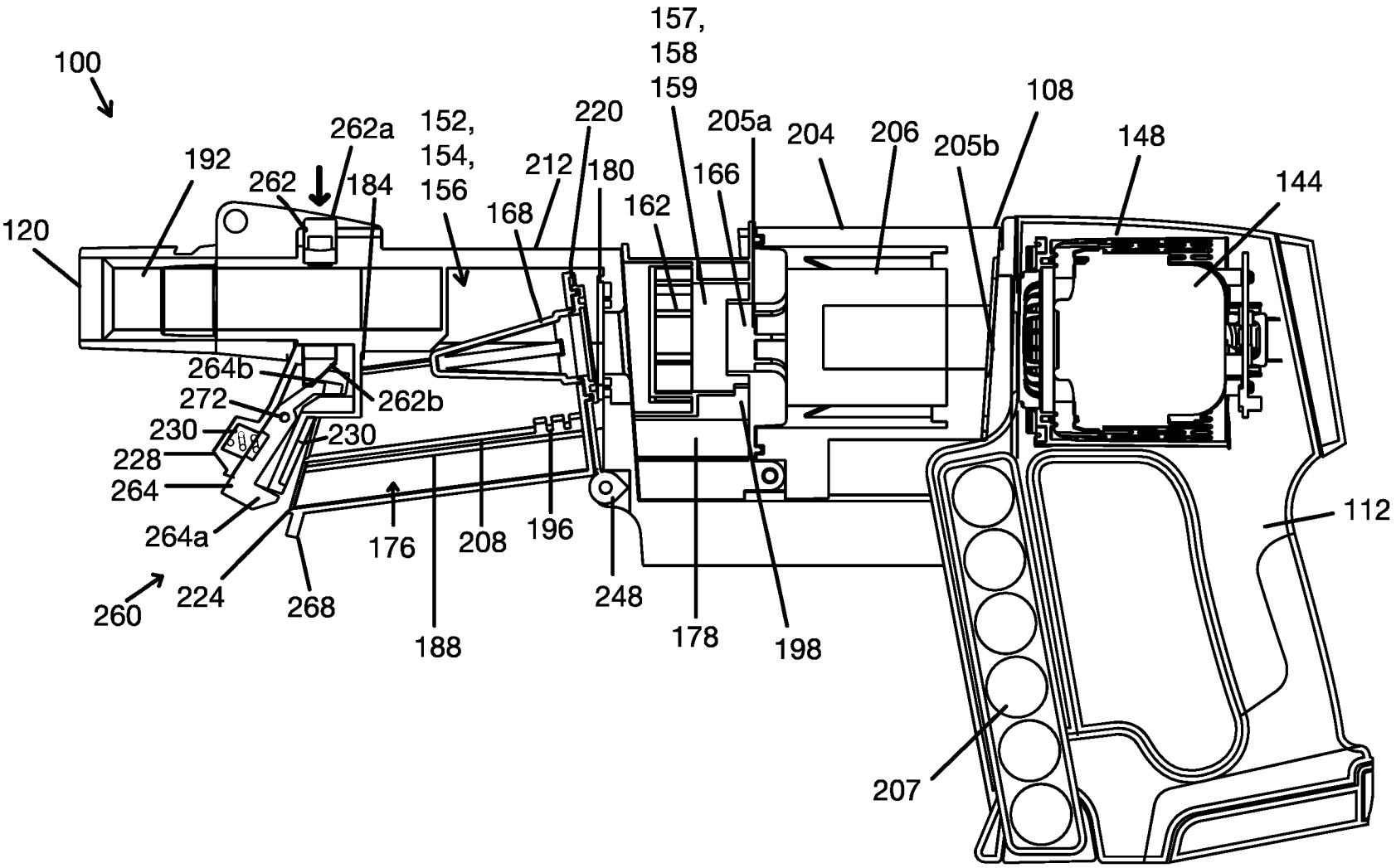
FIG. 3 is a cross-sectional view of the hand vacuum cleaner, taken along section line 2-2' of FIG. 1, and showing a moveable cyclone sidewall portion in a partially open position.

Optionally, as exemplified in FIGS. 2 and 3, the hand vacuum 100 may also include a pre-motor filter housing 204 positioned in the air flow path downstream from the air treatment member 116, and upstream from the suction motor 144. Pre-motor filter housing 204 may be of any suitable construction. A pre-motor filter 206, formed from any suitable physical, porous filter media (e.g., one or more of a foam filter, felt filter, HEPA filter, other physical filter media, electrostatic filter, etc.) and having any suitable shape, is positioned within the pre-motor filter housing 204. In embodiments where the pre-motor filter is provided, air flow may pass from the air treatment member 116 into an air inlet 205*a* of the pre-motor filter 206. Filtered air then exits through an air outlet 205*b* of the pre-motor filter 206 and continues downstream to the suction motor 144.

In some embodiments, a post-motor filter (not shown) may be provided downstream of suction motor 144. Accordingly, prior to exiting the clean air outlet 124 of the hand vacuum 100, treated air may first pass through the post-motor filter, which may also include one or more layers of filter media.

Openable Cyclone Sidewall Portion

The following is a discussion of an openable cyclone sidewall portion, which may be used by itself in any hand vacuum cleaner or in any combination or sub-combination with any other feature or features described herein. In particular, the openable sidewall portion may be used in combination with any moveable portion discussed herein As exemplified in FIGS. 2-5, cyclone sidewall 188, of cyclone 154, may comprise at least an openable portion 208 (also referred to herein as "a portion of the axially extending sidewall of the cyclone chamber"), and a stationary portion 212 (also referred to herein as "stationary cyclone sidewall portion", or "stationary sidewall portion"). As discussed subsequently, the openable portion 208 may also be translatable longitudinally to clean or assist in cleaning the porous member. In such a case, the moveable member may also be referred to as a "moveable cyclone sidewall portion", or a "moveable sidewall portion".

Figure 4:
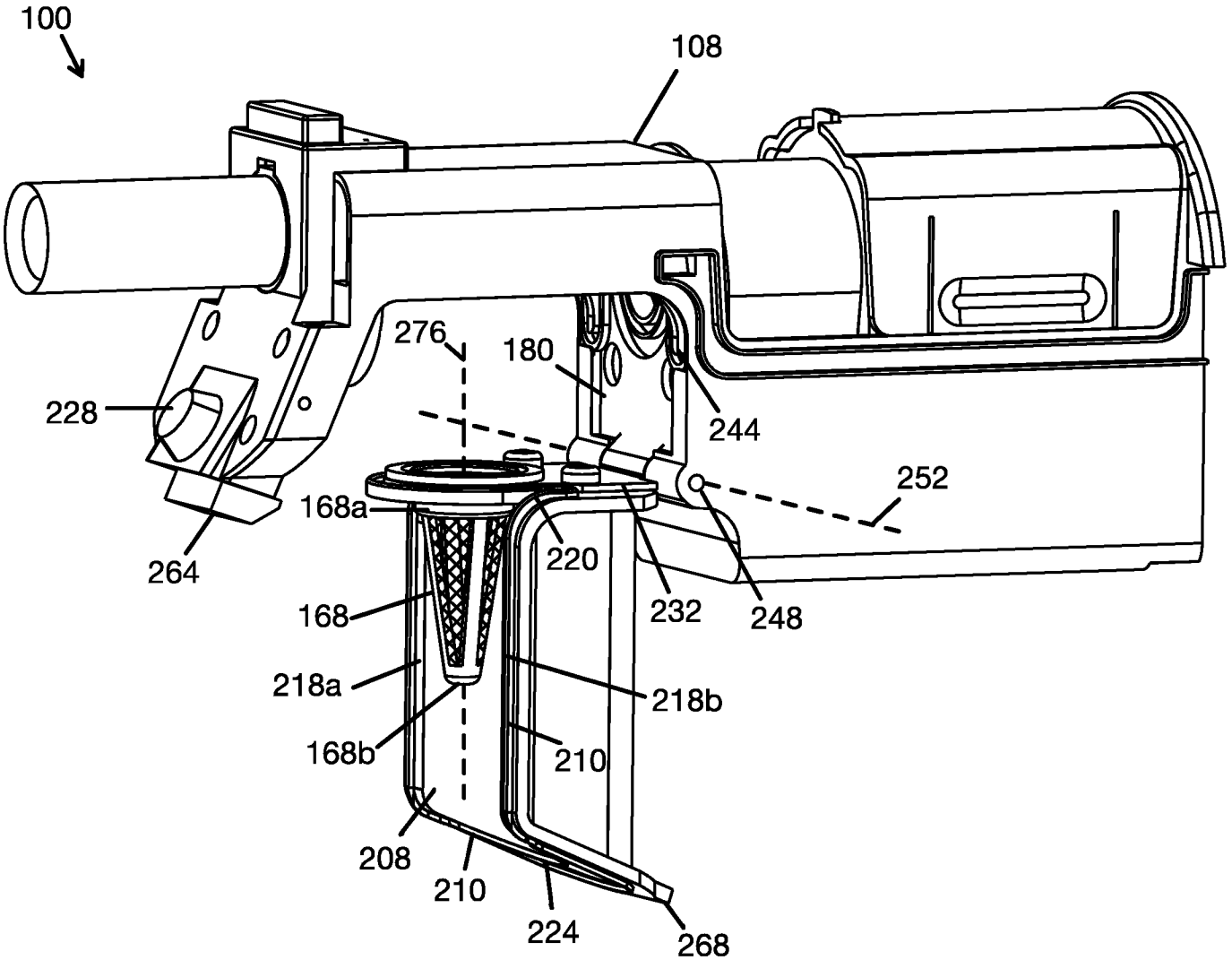
FIG. 4 is a side perspective view of a portion of the hand vacuum cleaner, and showing the moveable cyclone sidewall portion in an open position.

As exemplified, the openable portion 208 may move with respect to the hand vac housing 108 between a closed position (FIG. 2) and an open position (FIG. 4). In the closed position (FIG. 2), the sidewall 188 is continuous between the openable portion 208 and the stationary portion 212. In this configuration, the cyclone chamber 156 is closed and is operational for use in separating dirt and debris from airflow moving through the cyclone chamber 156. The juncture at the location at which the interior surface of the openable portion 208 meets the interior surface of the stationary portion 212 when the openable portion 208 is in the closed operational position is optionally smooth (i.e., there is no bump or other discontinuity). Accordingly, the interior of the cyclone sidewall is smooth when the moveable portion 208 is closed. In contrast, in the open position (FIG. 4), the sidewall 188 is at least partially discontinuous between the openable portion 208 and the stationary portion 212 as the moveable portion 208 is spaced from the stationary portion 212 to permit access to the interior of the cyclone.

In the exemplified embodiments, with the upper end 136 of the hand vacuum 100 positioned over the lower end 140, openable portion 208 generally comprises a lower segment of the sidewall 188, while stationary portion 212 generally comprises an upper segment of the sidewall 188. In other cases, openable portion 208 may comprise any other segment of the sidewall 188. For example, openable portion 208 may comprise the upper segment of sidewall 188, while stationary portion 212 can comprise the lower segment of sidewall 188. In still other cases, openable portion 208 may comprise a side/lateral segment of sidewall 188. Openable portion 208 can also comprise any proportion of the cyclone sidewall 188. For example, while the exemplified embodiments generally illustrate openable portion 208 as comprising approximately 50% of the total surface area of sidewall 188 (e.g., the lower "half" segment of sidewall 188, below the cyclone axis 172), in other embodiments, the openable portion 208 may comprise 20%, 30%, 40%, 60%, or 70% of the total surface area of sidewall 188.

Openable portion 208 may have any one of a number of suitable configurations or designs. In the exemplified embodiments, best shown in FIGS. 2, 4 and 5, the openable portion 208 comprises a first end 220 and an axially spaced apart second end 224. The axial distance between the first end 220 and the second end 224 defines the axial length 216 of the moveable portion 208 (FIG. 2). In some embodiments, the axial length 216 of moveable portion 208 may be substantially equal to the axial length 174 of cyclone chamber 156. In this configuration, when the openable portion 208 is in the closed position, the first end 220 is contiguous with the first cyclone end 180, and the second end 224 is contiguous with the second cyclone end 184. In other embodiments, the axial length 216 of moveable portion 208 may be greater than the cyclone axial length 174. For example, as exemplified in FIG. 2, the second end 224 of moveable portion 208 may extend beyond the second cyclone end 184, in the closed position. In still other embodiments, the axial length 216 of openable portion 208 may be less than the cyclone axial length 174. For example, the openable portion 208 may extend only part way from the first cyclone end 180 to the second cyclone end 184.

Figure 5:
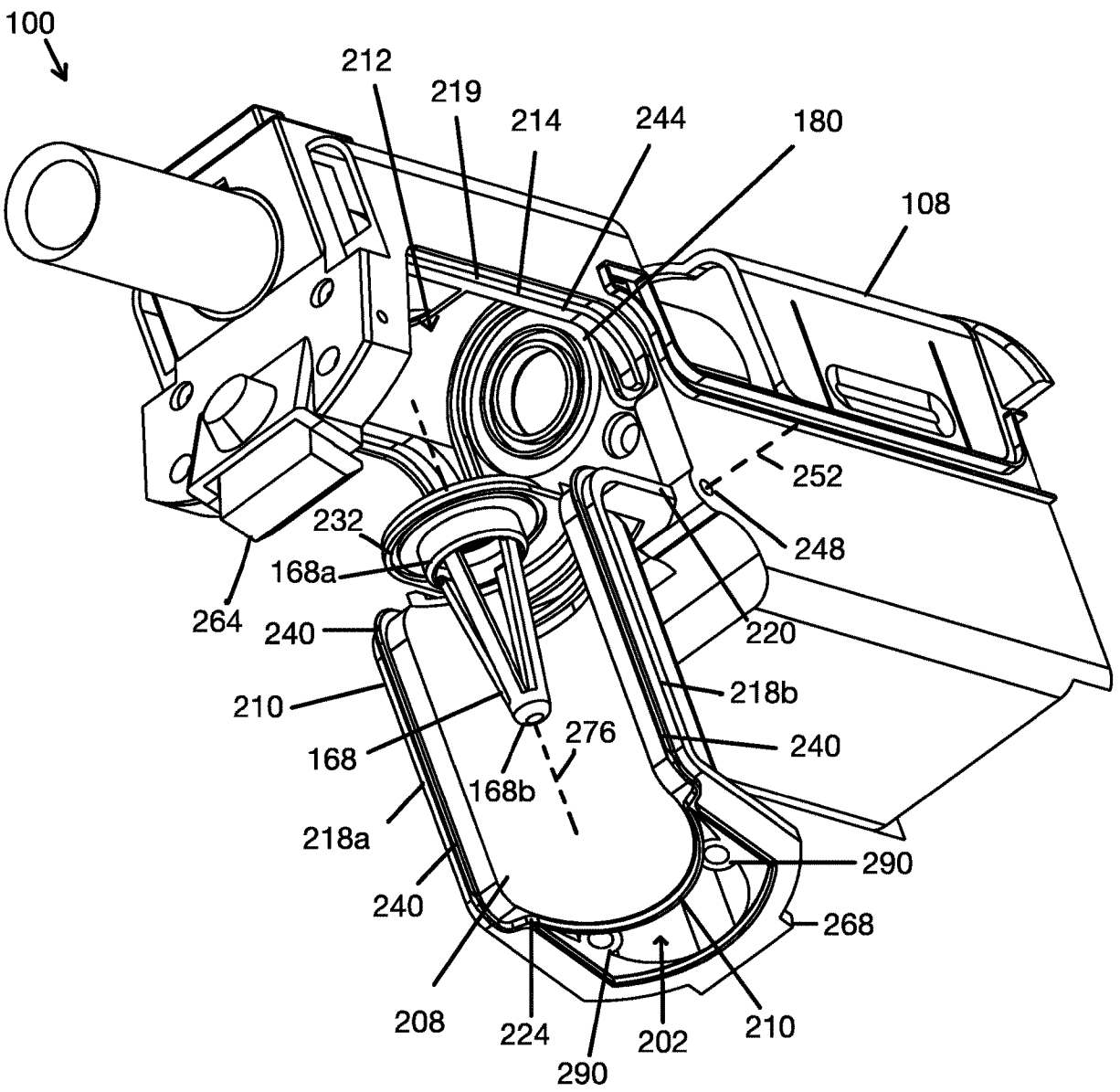
FIG. 5 is a bottom-up perspective view of a portion of the hand vacuum cleaner, and showing the moveable cyclone sidewall portion in the open position.

As best exemplified in FIG. 5, openable portion 208 may include peripheral edges 210. In the closed position, peripheral edges 210 abut (e.g., engage) edges 214 of stationary portion 212. As exemplified, peripheral edges 210, of moveable portion 208, may include one or more longitudinal portions 218*a*, 218*b*. Longitudinal portions 218*a*, 218*b* may extend axially between the first end 220 and second end 224 of portion 208. As exemplified in FIG. 2, in the closed position, longitudinal portions 218 are level with cyclone axis 172. In other embodiments, one or more of longitudinal edge 218*a*, 218*b* can be configured to be disposed above, or below, the cyclone axis 172, in the closed position.

Optionally, a sealing mechanism may be provided to seal the cyclone chamber 156 when the openable member 208 is in the closed position (FIG. 2). As exemplified, the sealing mechanism may comprise a "tongue and groove" fit between moveable portion 208 and stationary portion 212. In particular, as exemplified in FIG. 5, the moveable portion 208 may include a rib 240 (e.g., a "tongue") extending, at least partially along peripheral edge 210. In the closed position, rib 240 is receivable inside of a complimentary groove 244, extending at least partially along peripheral edge 214 of stationary portion 212. Accordingly, the "tongue-and-groove" fit may provide an air tight seal for the cyclone chamber 156 when the openable member 208 is in the closed position. In alternative embodiments, any other suitable sealing mechanism may be provided for air-tight sealing of cyclone chamber 156. For example, in some cases, a sealing member (e.g., gasket) may be disposed between the moveable sidewall portion 208 and the stationary sidewall portion 212, at the second cyclone end 184, whether or not a tongue and groove fit is utilized.

Openable cyclone sidewall portion 208 may be moveably mounted to the housing 108 between the open and closed positions in any manner known in the art. In the exemplified embodiments, the openable portion 208 is rotatably mounted (e.g., pivotally mounted) to housing 108. In particular, as exemplified in FIG. 4, the openable portion 208 may be secured to a back support plate 232 which, itself, is pivotally mounted to the housing 108, at the lower end of a back support plate 232 at the first cyclone end 180. As exemplified, the back support plate 232 is provided at the first cyclone end 180. In other embodiments, the moveable portion 208 may be rotatably mounted to housing 108 along a longitudinal edge 218. For example, a longitudinal edge 218, of openable portion 208, may be rotatably mounted to a longitudinal edge 219 of stationary cyclone sidewall portion 212 to open like a gull wing design. In other embodiments, the openable portion 208 may be simply detachable from housing 108 or translatable in a plane transverse to the cyclone axis, e.g., downwardly if the openable portion is a lower portion of the cyclone sidewall.

Any rotation (e.g., pivoting) structure may be used to allow movement of the openable portion 208 between the open and closed positions. For instance, in the exemplified embodiment, a hinge 248 is provided to pivotally secure support plate 232 to housing 108. Hinge 248 may have any suitable configuration to provide a pivotal or rotational connection between the support plate 232 and housing 108. For instance, as exemplified, hinge 248 can comprise a multi-part design. In other embodiments, hinge 248 can be a single-part living hinge. As best exemplified in FIG. 4, hinge 248 rotates about a rotation axis 252 (also referred to herein as a pivot axis), which is generally transverse to cyclone axis 172. In other cases, hinge 248 may have any other axis of rotation. In other embodiments, it will be appreciated that openable portion 208 may be pivotally mounted to, e.g., housing 108 and support plate 232 may remain in position when openable portion 208 is moved to the open position.

Openable portion 208 may be secured in the closed position by any means, such as a lock, an interference fit or the like. Optionally, a releasable lock mechanism 260 is provided to secure the openable portion 208 to housing 108 in the closed position, and to selectively allow separation of the openable portion 208 from the housing 108 into the open position.

In the illustrated example embodiment, the releasable lock mechanism 260 comprises a "latch hook" mechanism. In particular, as best exemplified in FIGS. 2 and 3, the "latch hook" mechanism comprises a latch 264 and a hook 268. The latch 264 is located at the front end 128 of housing 108, and the hook 268 is located proximal the second end 224 of moveable portion 208.

As exemplified, latch 264 may be rotatable between a "locked" position (FIG. 2) and an "un-locked" position (FIG. 3). In the "locked" position (FIG. 2), latch 264 may engage hook 268 at a lower latch portion. In this configuration, latch 264 retains the openable portion 208 in the closed position. In the "unlocked position" (FIG. 3), latch 264 may rotate away (e.g., forwardly) to dis-engage from hook 268. In this configuration, the openable portion 208 is free to move into the open position. In the exemplified embodiment, latch 264 can rotate between the "locked" and "unlocked" positons about a pivot point 272. Pivot point 272 can have, for example, an axis of rotation, which is substantially parallel to rotation axis 252 of hinge 248.

Latch 264 may be rotated between the "locked" and "unlocked" positons in any suitable manner. For example, a user may manually rotate the latch 264 between the "locked" and "unlocked" positions. Alternatively, or in addition, an actuator 262 may be provided to rotate latch 264 into the "unlocked" position. For example, as exemplified in FIGS. 2 and 3, when the upper end 136 of the hand vacuum 100 is positioned over the lower end 140, the actuator 262, which may be provided at an upper end of housing 108, may be depressed downwardly by a user by applying a force to top surface 262*a* of actuator 262. As the actuator 262 is depressed downwardly, the bottom surface 262*b* of actuator 262 engages a top portion 264*b* of latch 264. In this manner, actuator 262 forces the latch 264 to rotate, about pivot points 272, to the "unlocked" position (FIG. 3). In other embodiments, the release mechanism 260 may not comprise a releasable hook-and-latch mechanism, but may comprise a snap, magnet, strap, friction fit or any other suitable mechanism which allows selective locking and unlocking of the moveable sidewall portion 208 relative to the housing 108.

Optionally, a biasing mechanism is provided to bias the latch 264 to the "locked" or "unlocked" position. In the exemplified embodiments (FIGS. 2 and 3), the biasing mechanism comprises a biasing spring 230 biased to an expanded position. The spring 230 may be accommodated between latch 264, and a front depending wall 228 of housing 108. In the expanded position, spring 230 may bias the hook 264 into the "locked" configuration. A force is then applied (e.g., by actuator 262), to compress spring 230, and rotate the hook 264 into the "unlocked" position.

Optionally, one or more parts of the first stage cyclone 152 may move (e.g., rotate) with the moveable portion 208, between the open and closed positions.

For instance, as exemplified, the external dirt collection chamber 176 may move concurrently with openable portion 208 between the open and closed positions. An advantage of this configuration is that by opening the openable portion 208, dirt chamber 176 is accessible for emptying and cleaning. For instance, as exemplified in FIG. 5, the dirt chamber 176 may be emptied in the open position via opening 202, located proximal the second end 224 of openable portion 208. In addition, or in the alternative, dirt chamber 176 may be independently openable from openable portion 208.

Alternately, or in addition, screen 168 may also be moveable concurrently with the openable portion 208. For instance, as exemplified in FIG. 5, screen 168 may be supported to back support plate 232. In this configuration, screen 168 may move with sidewall portion 208 between the open and closed positions. An advantage of this configuration is that, in the open position, screen 168 may be more easily accessed and cleaned or debrided from dirt and debris.

In still further embodiments, as exemplified in FIGS. 14-20, the cyclone assembly 150 may include a cleaning member 236. As explained in further detail subsequently, the cleaning member 236 may be used for wiping dirt and debris from part or all of the exterior surface of screen 168. In embodiments in which a cleaning member 236 is provided, the cleaning member 236 may at least partially surround the screen 168 when disposed along the axial length of the screen 168. The cleaning member 236 may have any suitable design known in the art. For instance, as exemplified, the cleaning member 236 may have an annular shape. In various cases, as also explained herein, the cleaning member 236 may be supported by the sidewall portion 208. In this configuration, the cleaning member 236 may be concurrently moveable with the openable sidewall portion 208 between the open and closed positions.

Moveable Member

The following is a discussion of a moveable member, which may be used by itself or with one or more other aspects of this disclosure.

Optionally, as exemplified herein, the hand vacuum may include a moveable member which comprises at least one of the openable portion of the sidewall, the porous member (e.g., screen) and the cleaning member. The moveable member enables the screen 168 to be cleaned. Accordingly, the moveable member may move to expose or further expose the screen 168 so that a user may access the screen 168 to remove particulate matter on the screen 168 and/or to remove particulate matter from part of all of the screen 168. The moveable member may move between an operating position and one or more cleaning positions as, or subsequent to, the openable sidewall portion 208 being opened.

The operating position defines the position of the moveable member when the cyclone is closed (i.e., the openable portion 208 is in the closed position). Therefore, the operating position may be the position of the moveable member as it is located immediately after the sidewall portion 208 is opened. In general, in the operating position, the moveable member may be positioned toward (e.g., proximal) the first cyclone end.

The moveable member may be translated longitudinally away from the first cyclone end to one or more cleaning positions. As explained in further detail herein, an advantage of this configuration is that the cleaning position can facilitate cleaning of the screen and/or the cyclone chamber from dirt and debris.

Optionally, a biasing mechanism is provided to bias the moveable member into the cleaning position. The biasing mechanism may automatically translate the moveable member to the cleaning position as, or subsequent to, the sidewall portion 208 being opened. Accordingly, the biasing mechanism avoids the necessity of having a user manually translate the moveable member from the operating position into the cleaning position. In other embodiments, the biasing mechanism can bias the moveable member into the operating position. It will be appreciated that, whether or not a biasing mechanism is provided, an actuator may be provided to enable a user to manually move the moveable member. Accordingly, a handle, flange or the like may be provided on the moveable member to enable a user to manually move the moveable member between the operational position and one or more cleaning positions.

FIGS. 6-12 exemplify a first configuration of the moveable member in which the moveable member comprises at least the openable cyclone sidewall portion 208.

As exemplified, the sidewall portion 208 may be moveable between an operating position (FIGS. 6 and 7), and one or more cleaning positions (FIGS. 8-12). In the operating position (FIGS. 6 and 7), sidewall portion 208 is positioned as it is located during operation of the surface cleaning apparatus, which if the openable sidewall portion 208 does not move as it is opened, may be the same position immediately after the sidewall portion 208 is opened. In particular, as exemplified, the first end 220 of sidewall portion 208 abuts (e.g., engages) support plate 232. From the operating position, sidewall portion 208 may translate longitudinally into a cleaning position. As exemplified in FIGS. 8-12, sidewall portion 208 may translate into a cleaning position by translating away from the first cyclone end 180 (and/or support plate 232), along a translation axis 276. In the exemplified embodiments, translation axis 276 is oriented generally orthogonal to rotation axis 252 of hinge 248 (FIG. 6) and when the sidewall portion 208 is closed, parallel to the cyclone axis. In other cases, translation axis 276 may be oriented in any other suitable direction (e.g., at an angle to rotation axis 252).

Figure 11:
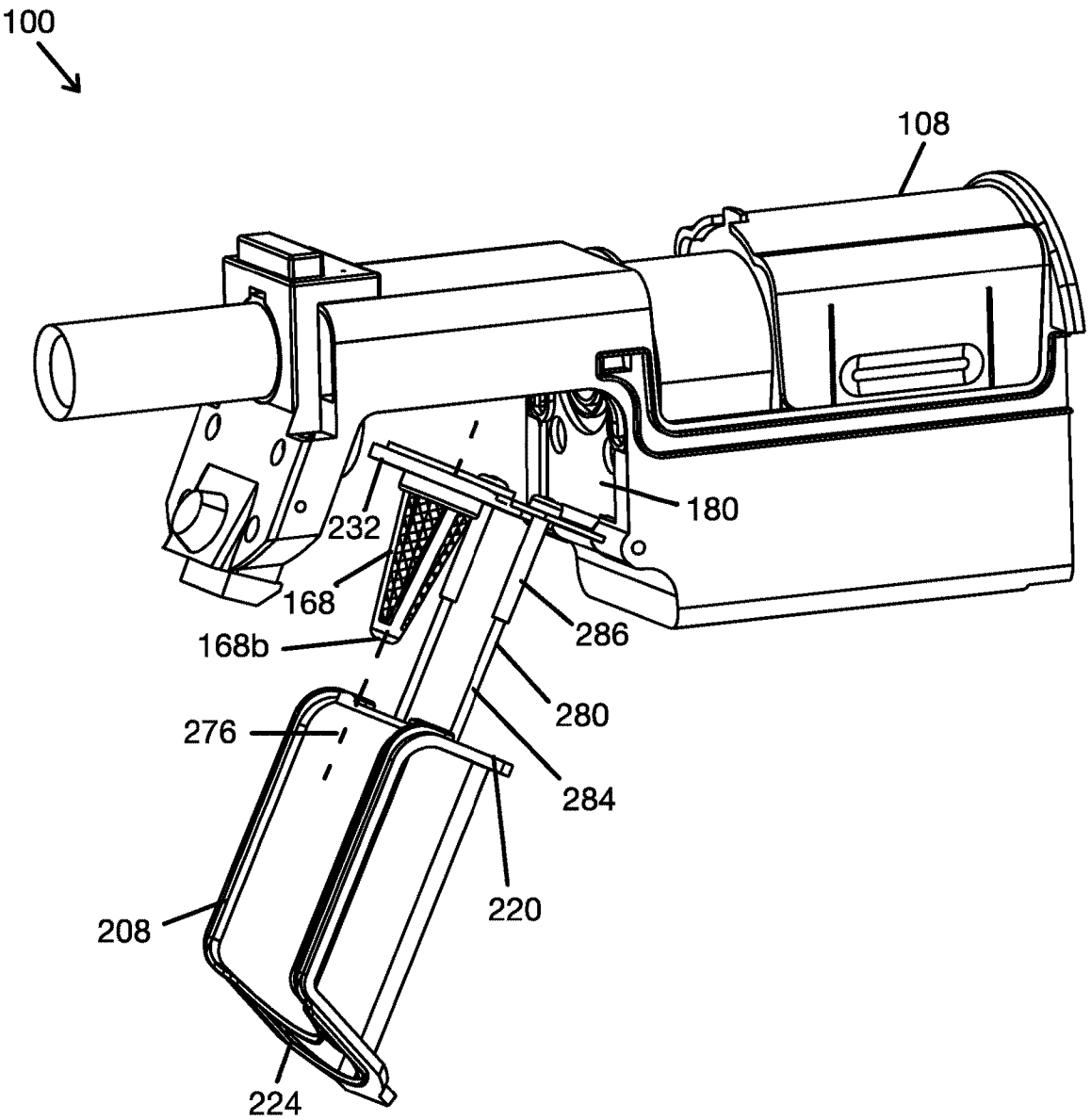
FIG. 11 is a side perspective of a portion of the hand vacuum cleaner, and showing the moveable sidewall portion extended still yet further into a cleaning position.
Figure 12:
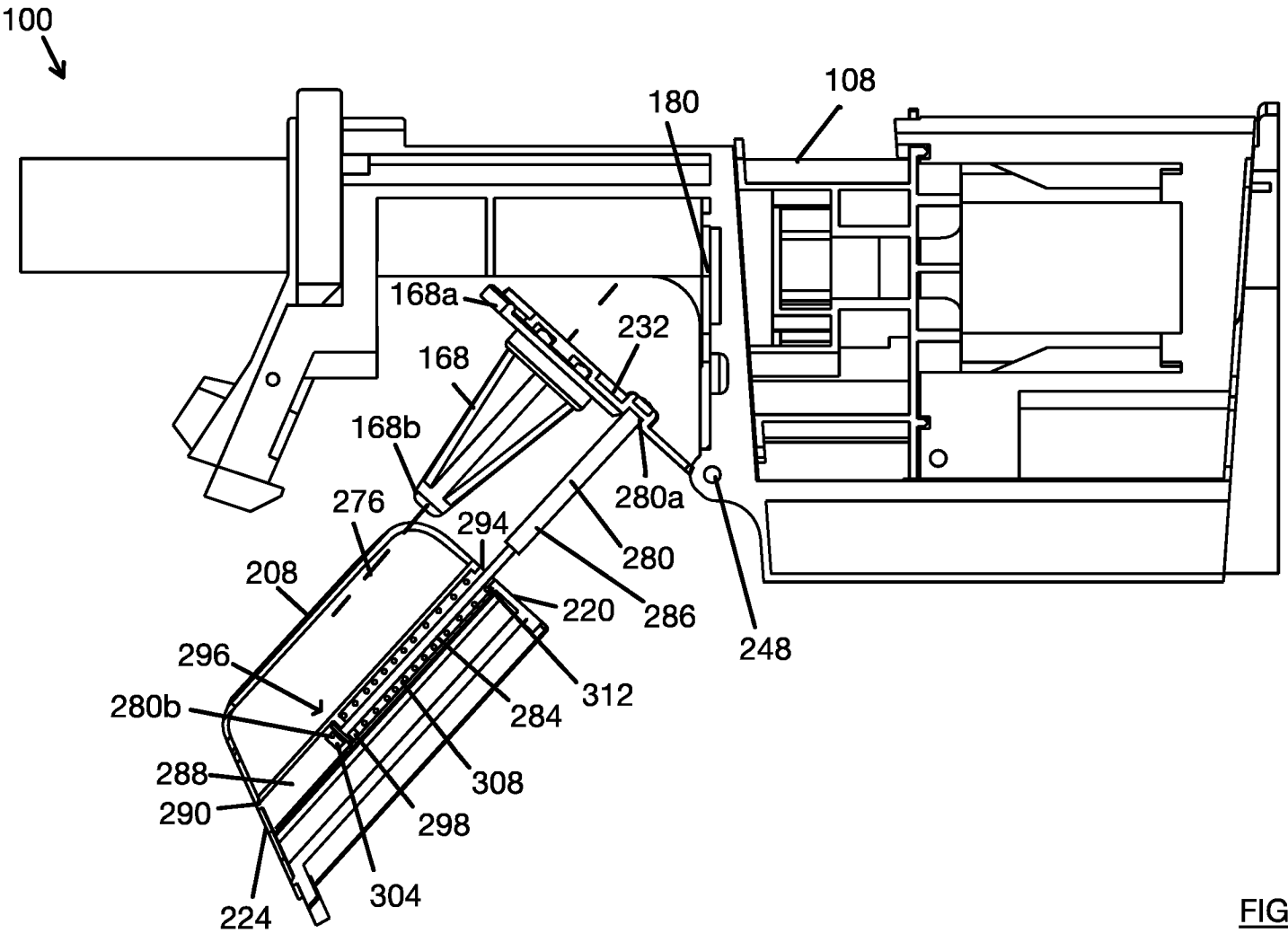
FIG. 12 is a cross-sectional view of a portion of the hand vacuum cleaner, taken along section line 6-6' of FIG. 1, and showing the moveable sidewall portion in the position of FIG. 11.

As exemplified, sidewall portion 208 may translate, away from first cyclone end 180, by any suitable distance, to translate into a cleaning position. For example, sidewall portion 208 may extend part-way along the axial length 169 of the screen 168 (FIGS. 8 and 9), and/or to the second end 168*b* of screen 168 (FIG. 10), and/or beyond the axial length of screen 168 (FIGS. 11 and 12).

It will be appreciated that an advantage of moving sidewall portion 208 into a cleaning position is to provide greater access to screen 168. For example, by moving sidewall portion 208 away from screen 168 (FIGS. 11 and 12), screen 168 is more easily accessed (e.g., by a user) to wipe dirt and debris. Further, translating sidewall portion 208 into a cleaning position may facilitate access to the cyclone chamber 156 in order to clean accumulated dirt and debris in the cyclone chamber. Still further, if the external dirt collection chamber 176 translates concurrently with sidewall portion 208, then translating sidewall portion 208 into a cleaning position may simplify access and cleaning of the dirt chamber 176 (e.g., via open end 202).

Sidewall portion 208 may be translated between the operating and cleaning positions in any manner known in the art. In the exemplified embodiments of FIGS. 7-12, extension rods 280 are provided for translating the sidewall portion 208 into the cleaning position. While the illustrated embodiments exemplify two extension rods 280, in other cases, any number of extension rods 280 may be provided for translating sidewall portion 208.

Figure 6:
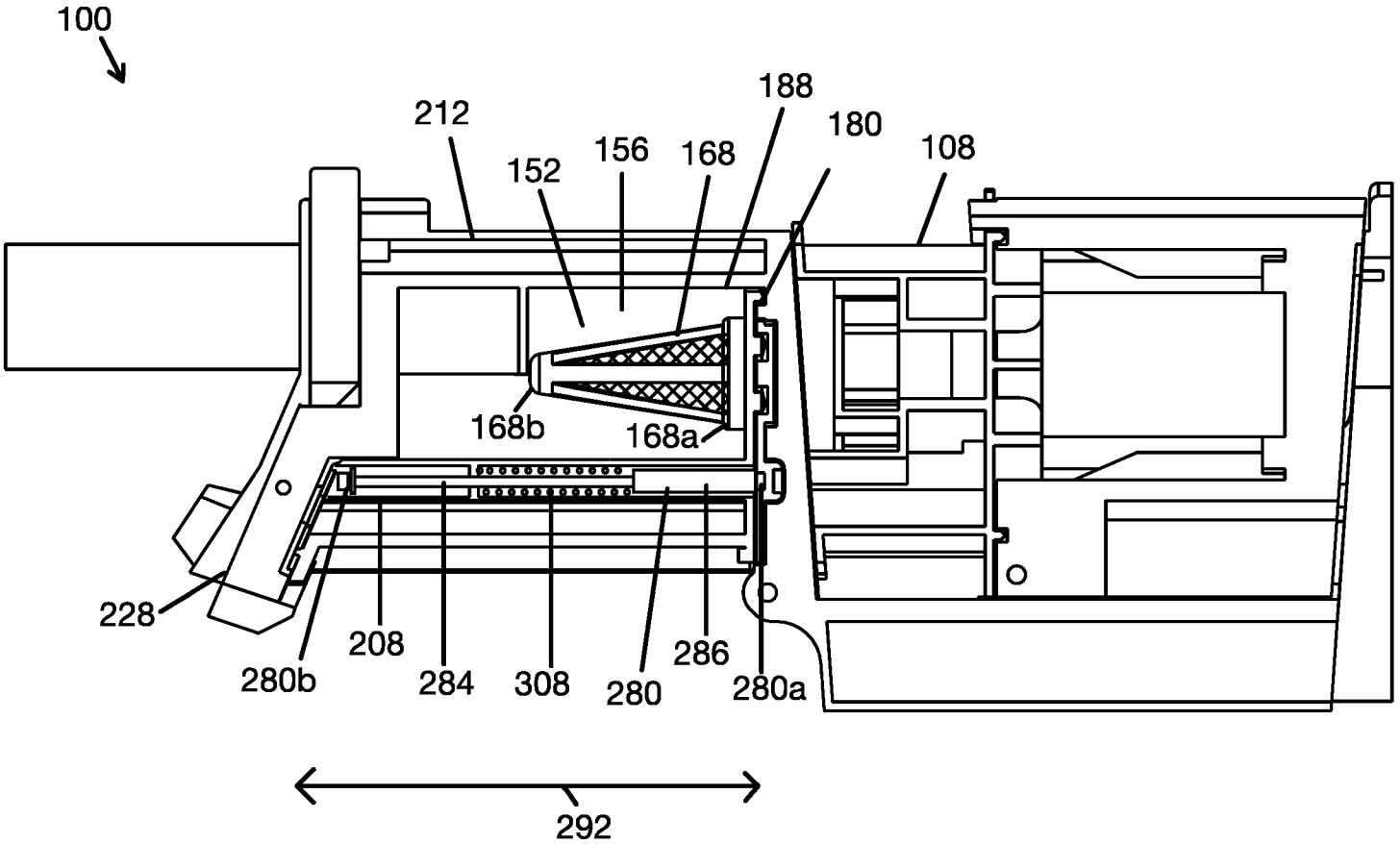
FIG. 6 is a cross-sectional view of a portion of the hand vacuum cleaner, taken along section line 6-6' of FIG. 1.
Figure 7:
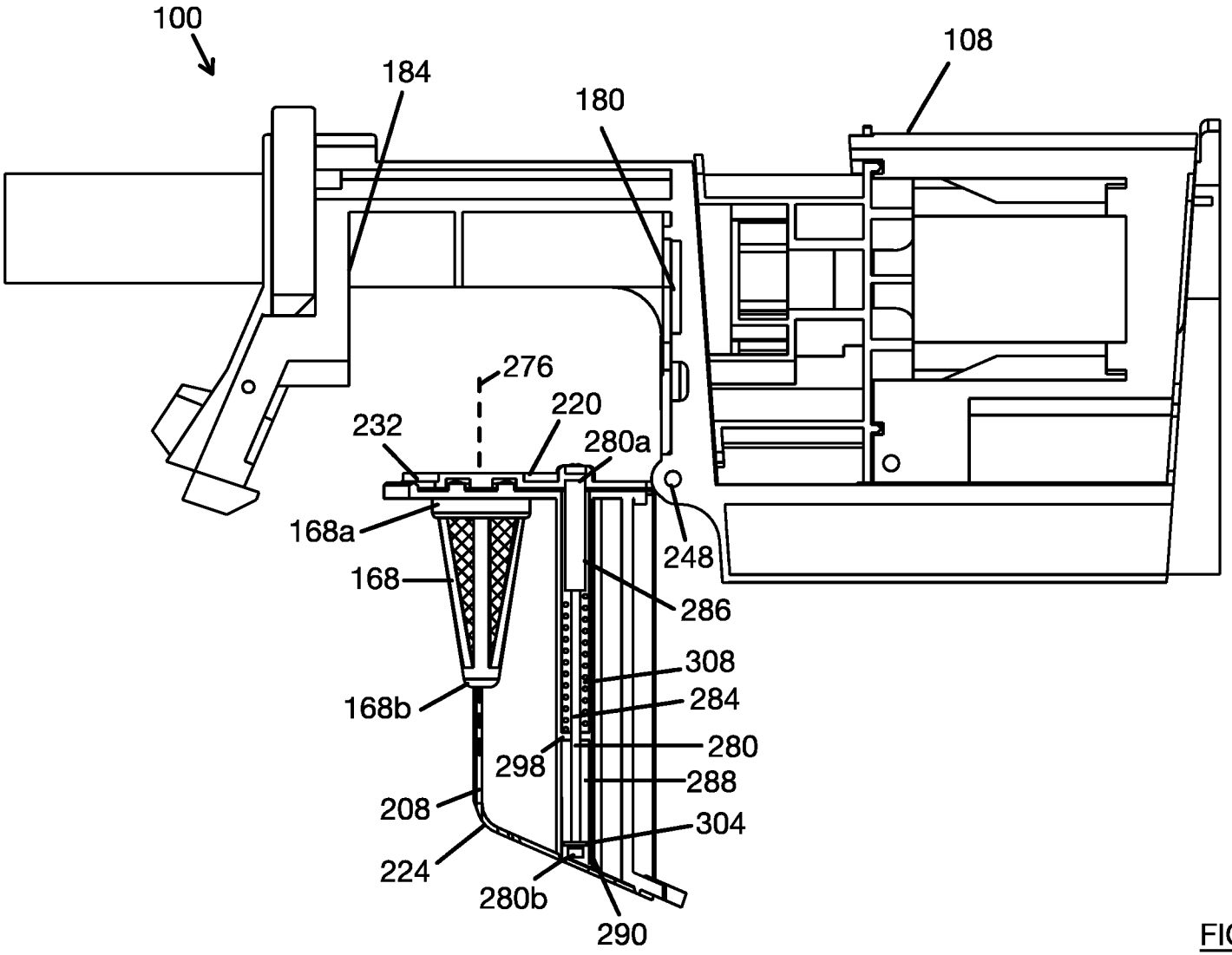
FIG. 7 is a cross-sectional view of a portion of the hand vacuum cleaner, taken along section line 6-6' of FIG. 1, and showing the moveable cyclone sidewall portion in the open position.
Figure 8:
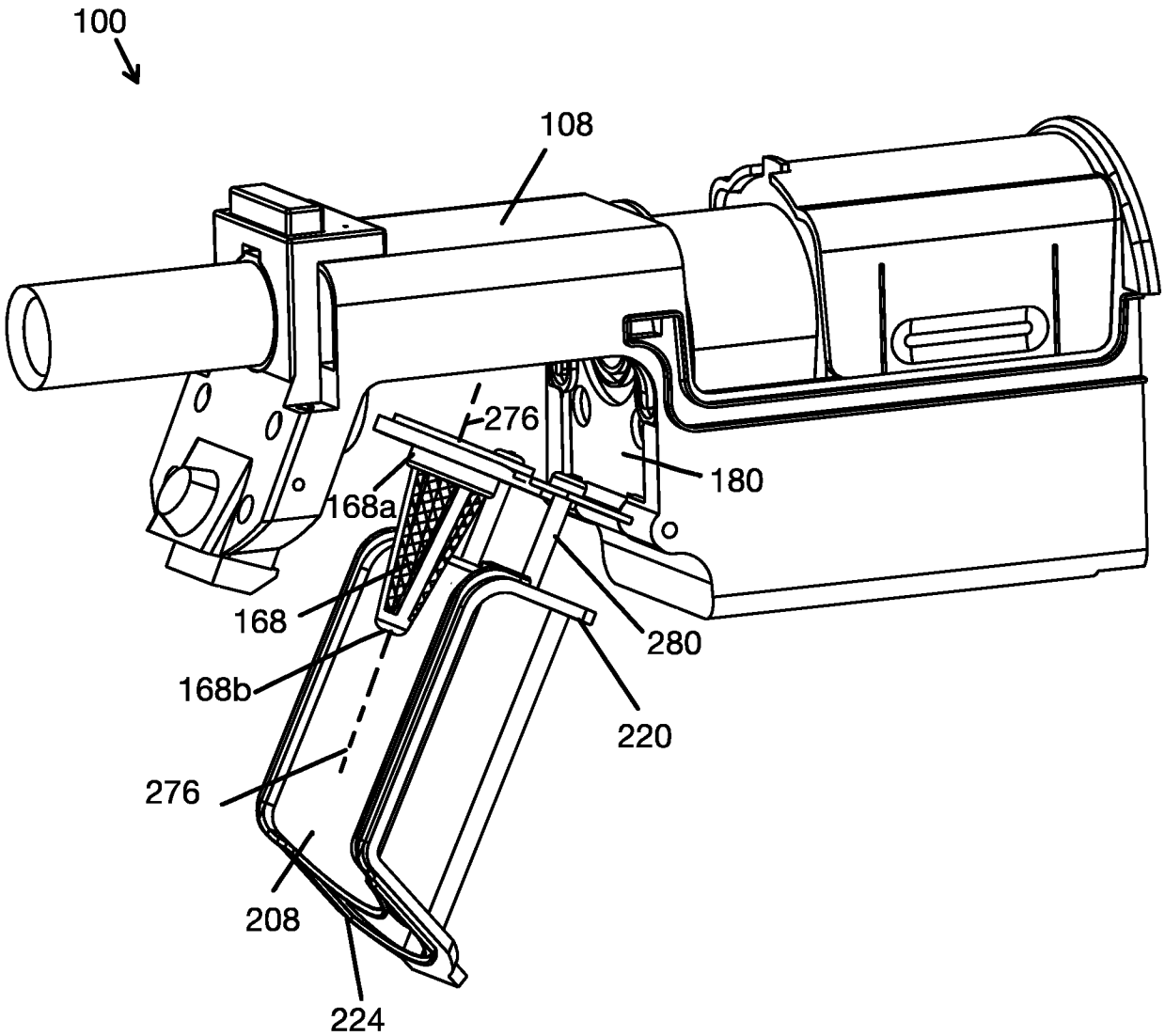
FIG. 8 is a side perspective of a portion of the hand vacuum cleaner, and showing the moveable sidewall portion extended longitudinally partially into a cleaning position.

As best exemplified in FIG. 7, each extension rod 280 may span, along translation axis 276, between a first end 280*a* and an axially spaced apart second end 280*b*. The axial distance between the first and second end defines the axial length 292 of extension rod 280 (FIG. 6). The axial length 292 of extension rods 280 may be variably configured. An advantage of having a greater axial length 292 is that sidewall portion 208 can extend further outwardly into a cleaning position. Preferably, where two or more extension rods 280 are provided as exemplified in FIG. 8, each extension rod 280 has an identical axial length.

As exemplified, the first end 280*a* of extension rods 280 may be secured (e.g., connected or attached) to the back support plate 232 if support plate 232 moves with sidewall portion 208.

As exemplified in FIG. 7, each extension rod 280 may be slidably received inside of an axially extending slot 288. As exemplified in FIG. 5, each slot 288 may be provided within a housing 290. In the illustrated example embodiment, when the sidewall portion 208 is in the open position, the housing 290 is located at a rear side of sidewall portion 208. In other cases, the housing 290 may be located in any other suitable location. For example, the housing 290 may be located at a forward side of the sidewall portion 208 when the sidewall portion 208 is in the open position. In still other cases, slots 288 may be formed within the sidewall portion 208.

Figure 9:
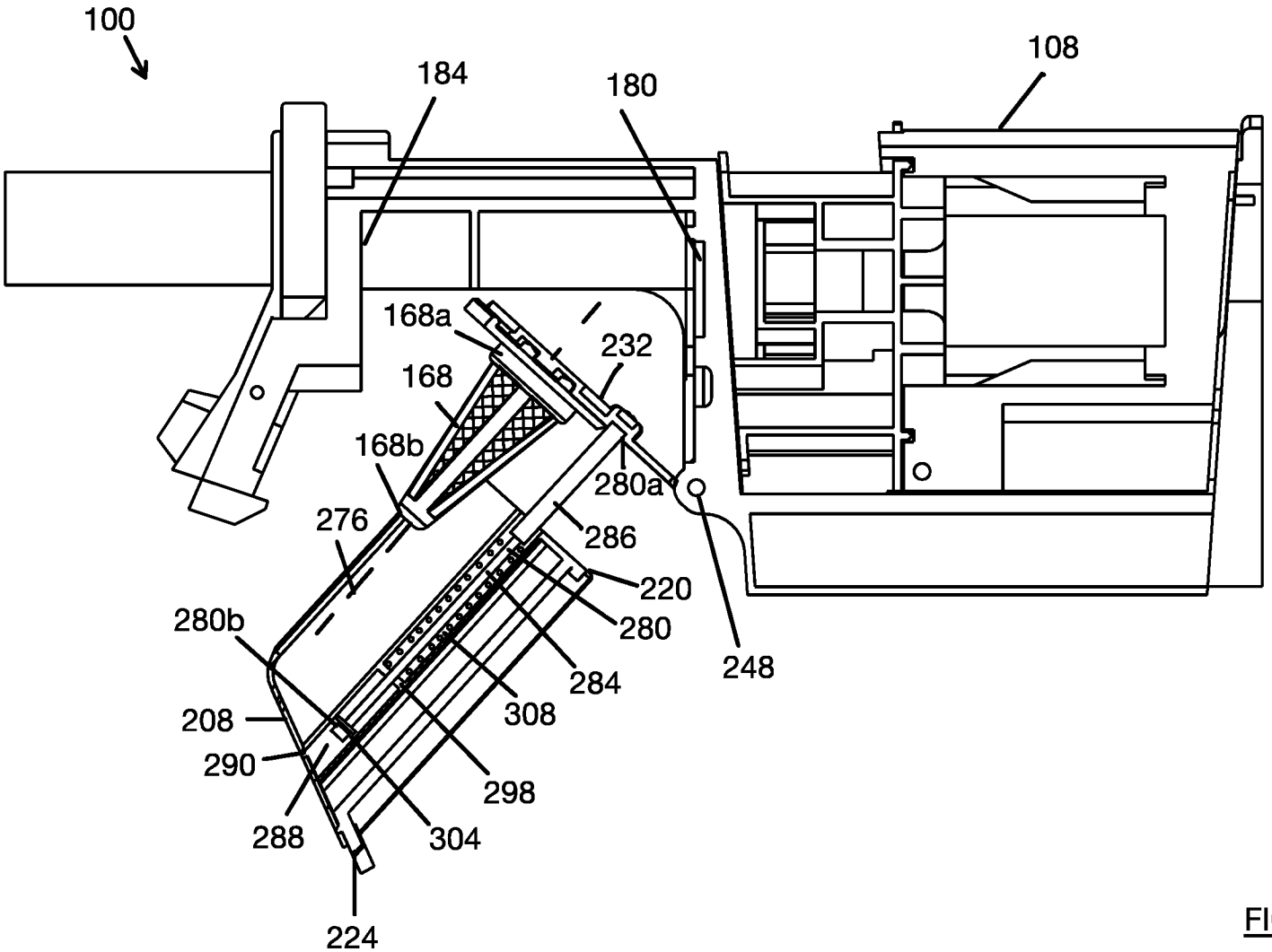
FIG. 9 is a cross-sectional view of a portion of the hand vacuum cleaner, taken along section line 6-6' of FIG. 1, and showing the moveable sidewall portion in the position of FIG. 8.
Figure 10:
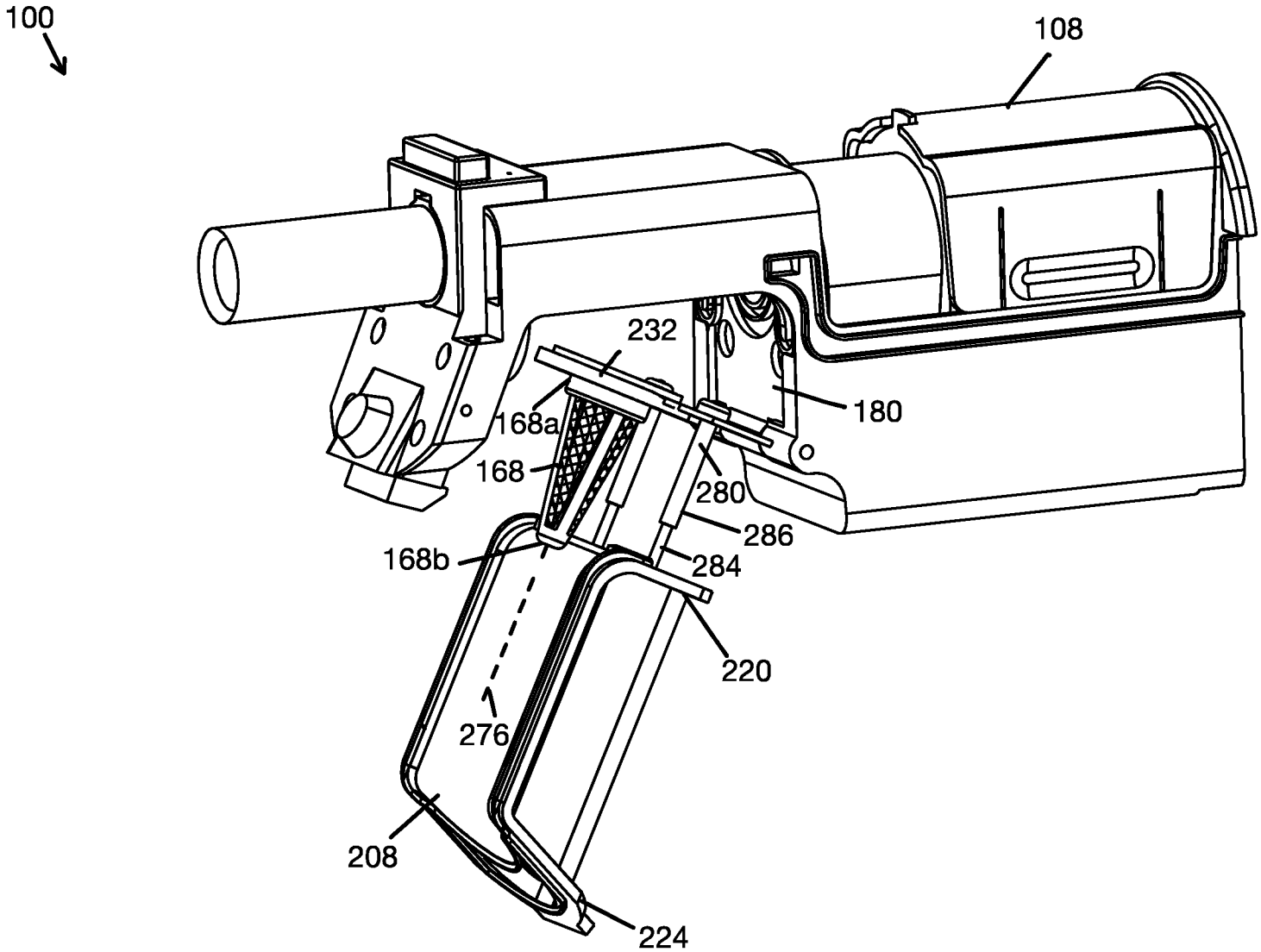
FIG. 10 is a side perspective of a portion of the hand vacuum cleaner, and showing the moveable sidewall portion further extended into a cleaning position.

As best exemplified in FIG. 7, each slot 288 extends axially, along translation axis 276, between the first end 220 of sidewall portion 208, and at least partially to the second end 224. Preferably, slots 288 extend axially at least the axial length 292 of extensions rod 280. In this manner, rods 280 are completely received within slots 288 in the operating position (FIG. 7). Each slot 288 includes at least one open end 294 located proximal at the first end 220 of sidewall portion 208 (FIG. 12). The open end 294 may slidably receive rod 280 (FIG. 9).

As exemplified in FIGS. 8-12, sidewall portion 208 may slide along the axial length of rod 280 to translate between the operating position and a cleaning position.

Optionally, as exemplified in FIG. 12, a stop structure 296 is provided to limit the maximum axial extension of sidewall portion 208. In other words, stop structure 296 prevents sidewall portion 208 from sliding beyond the axial length of rod 280, and detaching (e.g., disconnecting) from rod 280. In the exemplified embodiments, stop structure 296 comprises a stop flange 298, disposed inside of slot 288, and a stop member 304 located on rod 280. As exemplified in FIG. 12, at the maximum axial extension of sidewall portion 208, the stop member 304 engages stop flange 298 to prevent over extension of sidewall portion 208.

In the illustrated example embodiment, the stop member 304 is located proximal the second end 280*b* of rod 280 to maximize the extension of rod 280. It will be appreciated, however, that stop member 304 may be provided at any other suitable location along the axial length 292 of rod 280. Similarly, it will be appreciated the flange 298 may be positioned at any location along the axial length of the slot 288.

It will be appreciated that, in other embodiments, the sidewall portion 208 may be slidable beyond the axial length of rod 280 to enable the sidewall portion, and any member secured thereto such as screen 168 and/or the cleaning member, to detach.

Sidewall portion 208 may be translated between the operating and cleaning positions in any suitable manner. For example, in some cases, a user can simply extend (e.g., pull) the sidewall portion 208 from the operating position to the cleaning position. In particular, the user can extend the sidewall portion 208 into the cleaning position as, or subsequent to, moving the sidewall portion 208 into the open position. In other cases, where the top end 136 of the hand vacuum 100 is generally positioned over the lower end 140, the sidewall portion 208 can descend, under the influence of gravity, into the cleaning position. This may also occur as, or subsequent to, moving the sidewall portion 208 from the closed position to the open position. The user may grab the exterior of sidewall portion 208, or an actuator attached thereto, to effect manual movement of the sidewall portion 208.

Optionally, a biasing mechanism may be provided to bias the sidewall portion 208 into the cleaning position. An advantage of this configuration is that the biasing mechanism automatically translates the sidewall portion 208 into the cleaning position without manual intervention of a user.

As exemplified in FIGS. 6-9 and 12, the biasing mechanism may comprise a biasing spring 308, which is biased to an expanded position. As exemplified, the biasing spring 308 may be disposed inside of slot 288. To accommodate spring 308 inside slot 288, each rod 280 may comprise an upper portion 286 and a lower portion 284, whereby the lower portion 284 is smaller in diameter (e.g., width, or lateral span) than the upper portion 286. Accordingly, spring 308 may be disposed around the narrower lower portion 284, and between the stop flange 298 and the upper portion 286 (FIG. 7). Alternately, or in addition, a stop may be provided on rod 280 to limit the travel of spring 308 along rod 280.

It will also be appreciated that rods 280 may be telescopically configured.

In the operating position (e.g., FIGS. 3 and 7), spring 308 may be compressed between the upper portion 286 and stop flange 298. As, or subsequent to, moving sidewall portion 208 into the open position, spring 304 may expand outwardly. In expanding, spring 304 applies opposed axial forces to each of the stop flange 298 and the upper portion 286. In this manner, spring 304 forces sidewall portion 208 outwardly into the cleaning position (FIGS. 9 and 12). Optionally, as exemplified in FIG. 12, when sidewall portion 208 is extended to the maximum outward position, retention clips 312 retain spring 308 inside of slot 288. Retention clips 312 can be disposed at the open ends 294 of slots 288. In some cases, the biasing spring 308 may only bias the cleaning member 236 part way into the cleaning position. For example, the maximum axially expanded length of spring 308 may be less than the maximum extension of rod 280.

When it is desired to retract sidewall potion 208 back into the operating position, a reverse axial force is applied to sidewall portion 208. The reverse axial force may be applied, for example, by a user grabbing the outer surface of sidewall portion 208. Once the sidewall portion 208 is retracted to the operating position, the user may hold the sidewall portion 208 in the operating position while moving (e.g., rotating) the sidewall portion back into the closed position (FIG. 2). Alternately, the sidewall portion may be locked in the retracted operating position and then rotated into the closed portion.

While the illustrated embodiments exemplify the spring 308 as biasing sidewall portion 208 into the cleaning position, it will be appreciated that in alternative embodiments, spring 308 may bias sidewall portion 208 into the operating position. In this configuration, spring 308 may be biased into a compressed position. Accordingly, as, or subsequent to, moving the sidewall portion 208 into the open position, an outward axial force must be applied to extend the sidewall portion 208 into the cleaning position in order to overcome the spring's biasing force. The sidewall portion 208 may then be released allowing the spring 308 to contract, and in turn, retract sidewall portion 208 back into the operating position. In various cases, spring 308 may attach to each of the stop flange 298 and the upper portion 286 such that spring 308 may pull the flange 298 and upper portion 286, axially inwardly, to retract sidewall portion 208.

As exemplified in FIGS. 13-21, the moveable member comprises at least the cleaning member 236.

As exemplified, the cleaning member 236 may be separately translatable between an operating position (FIG. 13) and one or more cleaning positions (FIGS. 17-20).

As exemplified, in the operating position (FIG. 13), the cleaning member 236 may be generally disposed proximal the first end 220 of sidewall portion 208. An advantage of this position is that, in operation, the cleaning member may be recessed so as to not interfere in the cyclonic movement of air in the cyclone chamber. Accordingly, when sidewall portion 208 is in the closed position, the cleaning member may form part or all of the rear wall of the cyclone chamber at first end 180.

Figure 19:
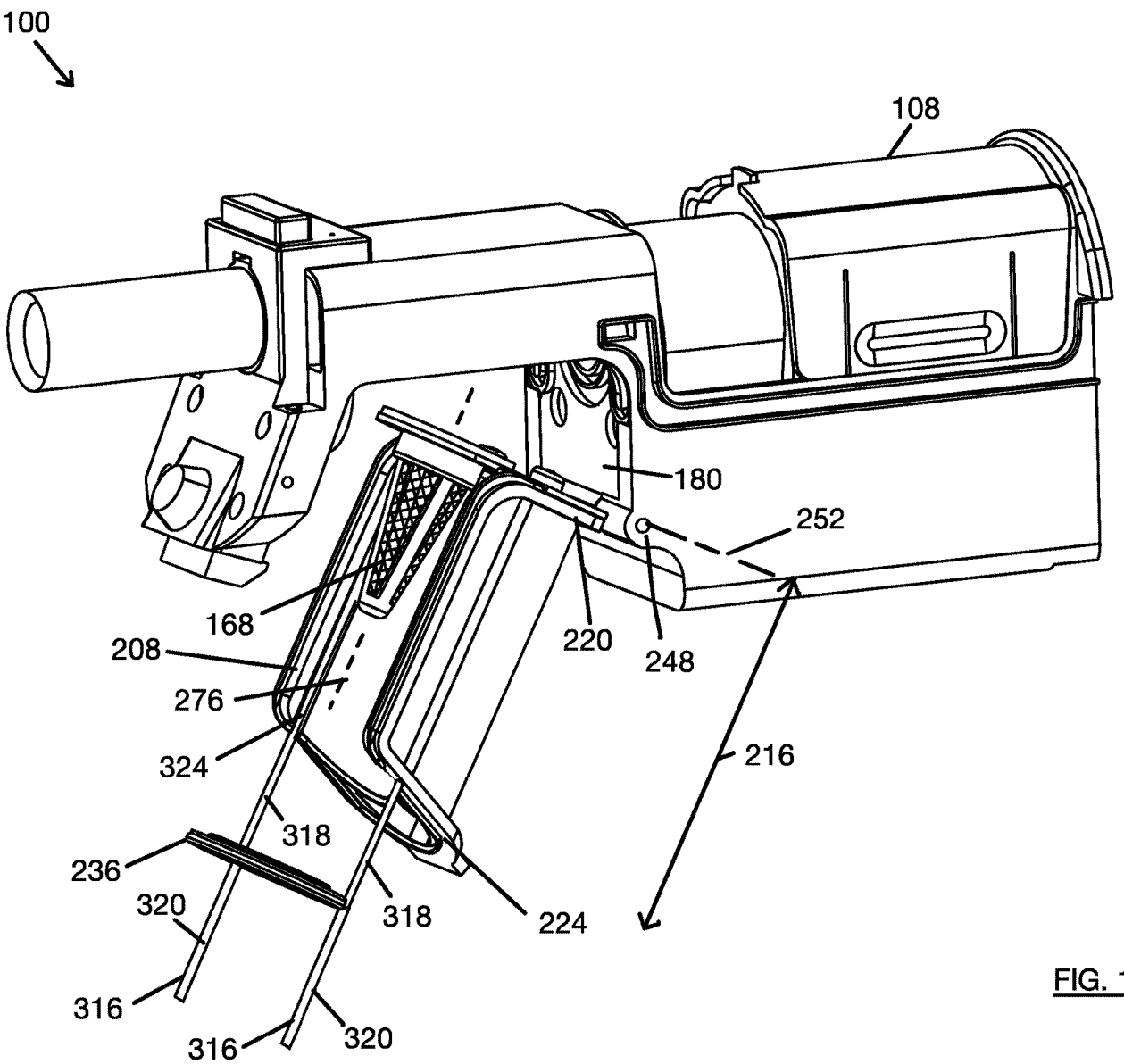
FIG. 19 is a side perspective view of a portion of the hand vacuum cleaner, and showing the cleaning member extended still yet further into a cleaning position.
Figure 20:
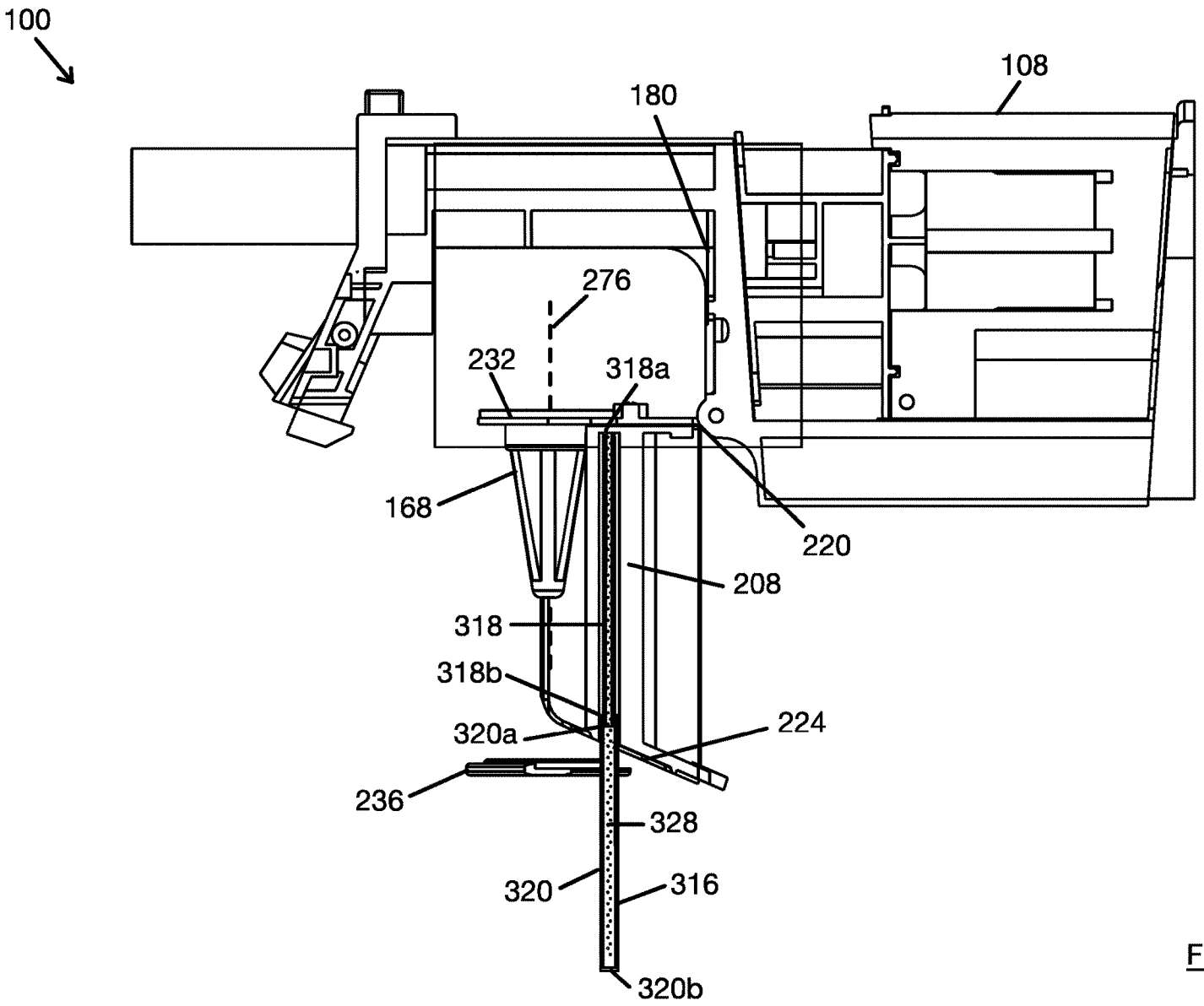
FIG. 20 is a cross-sectional view of a portion of the hand vacuum cleaner, taken along section line 13-13' of FIG. 1, and showing the cleaning member in the position of FIG. 19.

In the cleaning position, the cleaning member 236 may be axially translated, along translation axis 276, by any variable distance away from the first cyclone end 180. For example, the cleaning member 236 may be translated along the axial length 169 of the screen 168 (FIGS. 14-16), to the second end 168*b* of screen 168 (FIG. 17), beyond the axial length of screen 168 (FIG. 18), and/or beyond the axial length 216 of the sidewall portion 208 (FIGS. 19 and 20).

An advantage of this configuration is that, as the cleaning member 236 is translated to the cleaning position, the cleaning member 236 may wipe dirt and debris (e.g., large hair balls) from the exterior of screen 168. Cleaning member 236 may also push dirt and debris, wiped from screen 168, downwardly into a dirt collection bin located beneath the hand vacuum 100.

Cleaning member 236 may be translated from the operating position to a cleaning position in any manner known in the art. For instance, in the exemplified embodiments (FIGS. 17-20), cleaning member 236 is translated into the cleaning position using secondary extension members 316 (also referred herein as secondary extension rods). While two secondary extension members 316 are illustrated, any number of secondary extension members 316 can be provided for translating cleaning member 236.

Figure 14:
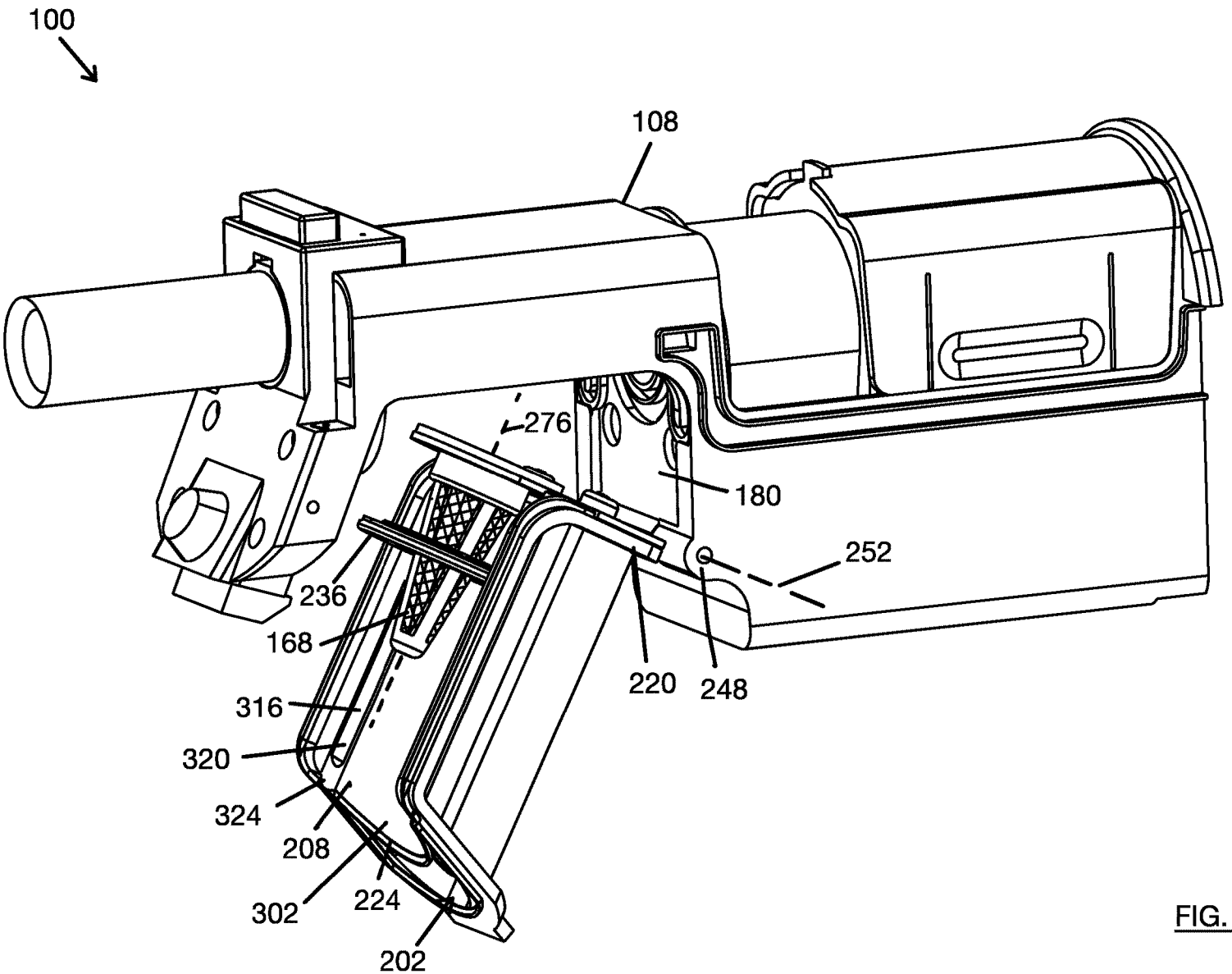
FIG. 14 is a side perspective of a portion of the hand vacuum cleaner, and showing the moveable sidewall portion in an open position, and further showing a cleaning member partially extended into a cleaning position.
Figure 15:
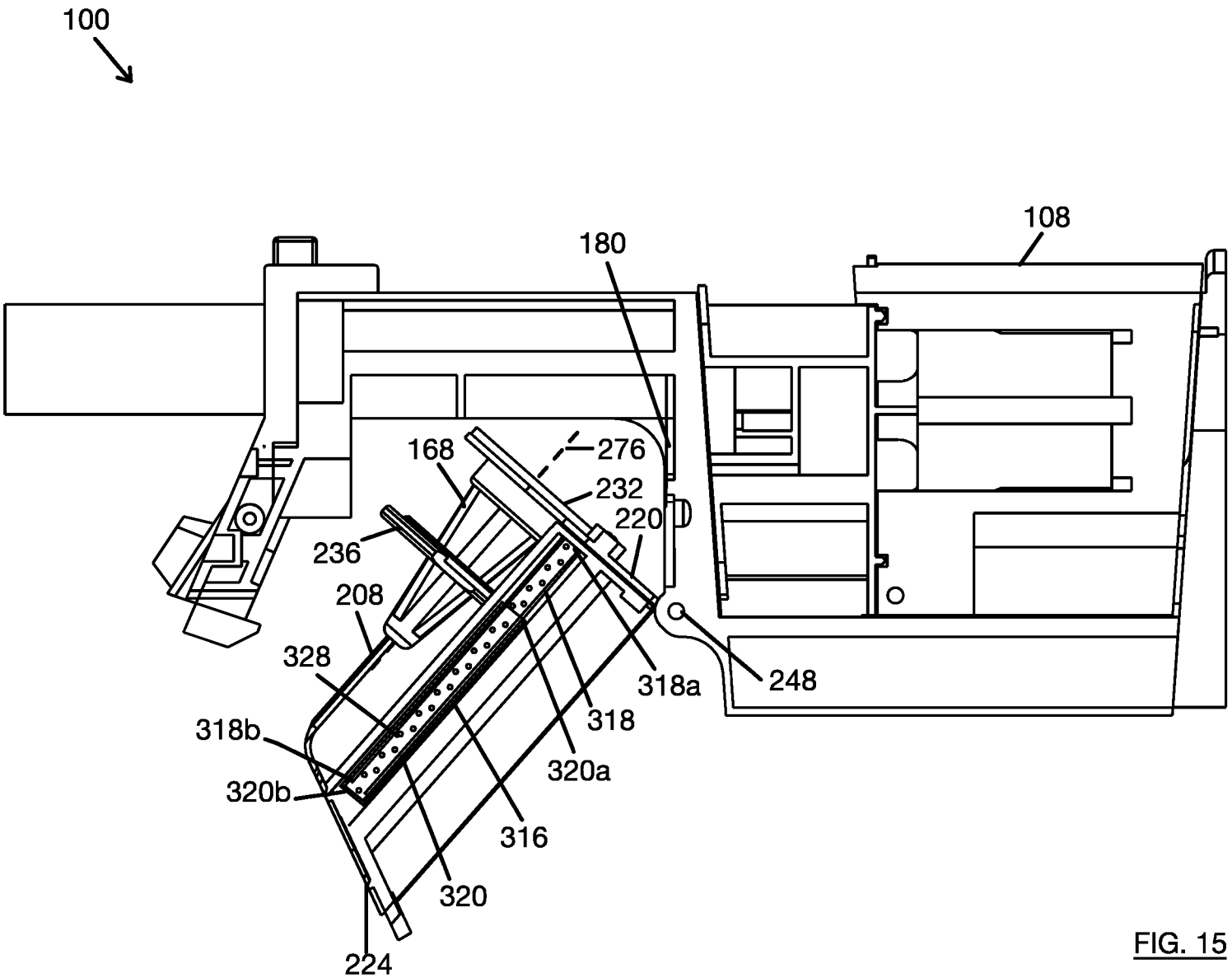
FIG. 15 is a cross-sectional view of a portion of the hand vacuum cleaner, taken along section line 13-13' of FIG. 1, and showing the cleaning member in the positon of FIG. 14.

As best exemplified in FIGS. 14 and 15, each extension rod 316 may be slidably received inside of a groove 324. Grooves 324 are formed along an inner surface 302 of sidewall portion 208. Each groove 324 may extend along translation axis 276 from first end 220 of moveable portion 208, and at least partially to second end 224. Alternately, the extension rods 316 may be mounted to screen 116 (e.g., they be ribs provided on an exterior of screen 168).

Figure 16:
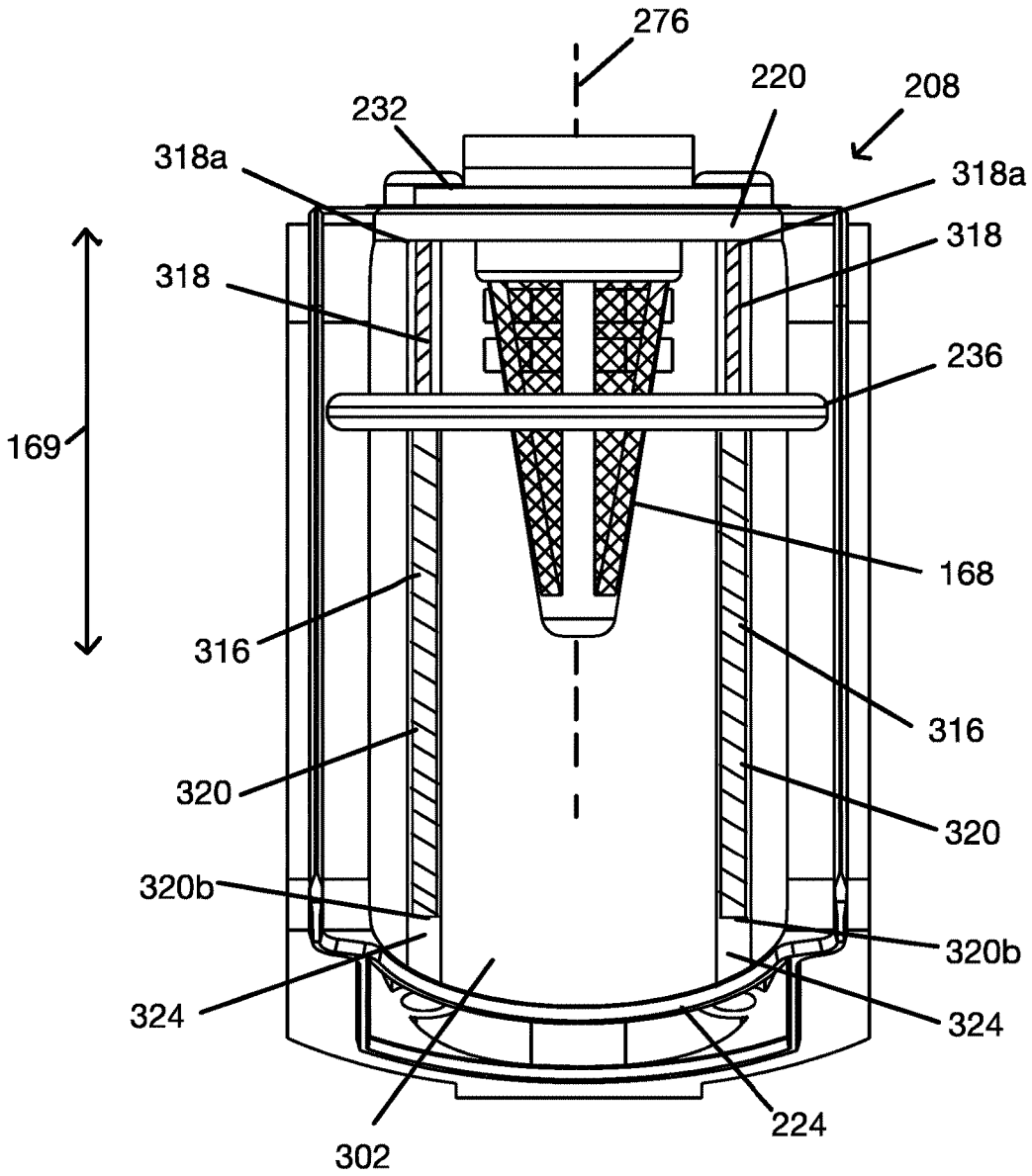
FIG. 16 is a front elevation view of the moveable cyclone sidewall portion, and showing the cleaning member in the position of FIG. 14.
Figure 17:
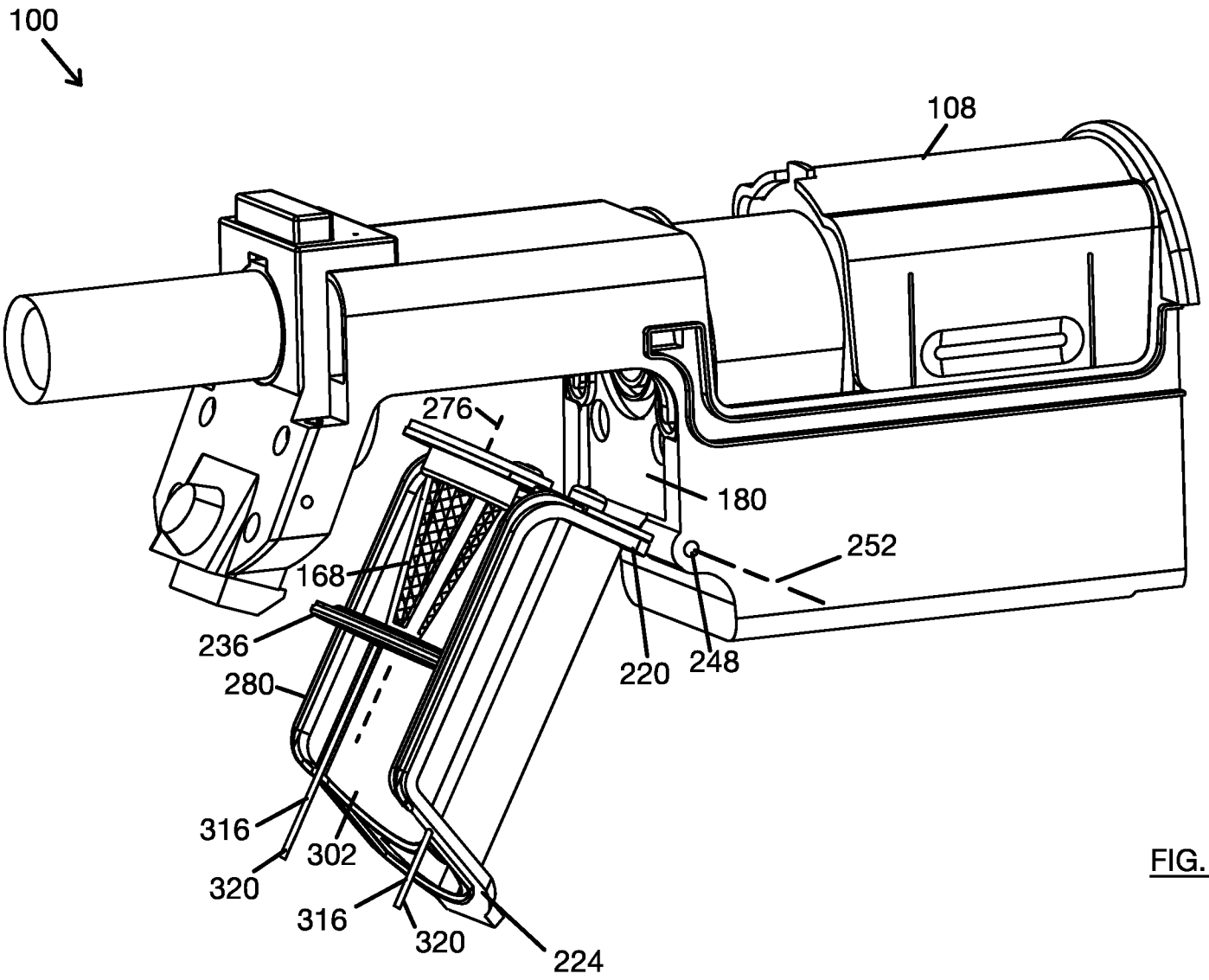
FIG. 17 is a side perspective view of a portion of the hand vacuum cleaner, and showing the cleaning member extended further into a cleaning position.
Figure 18:
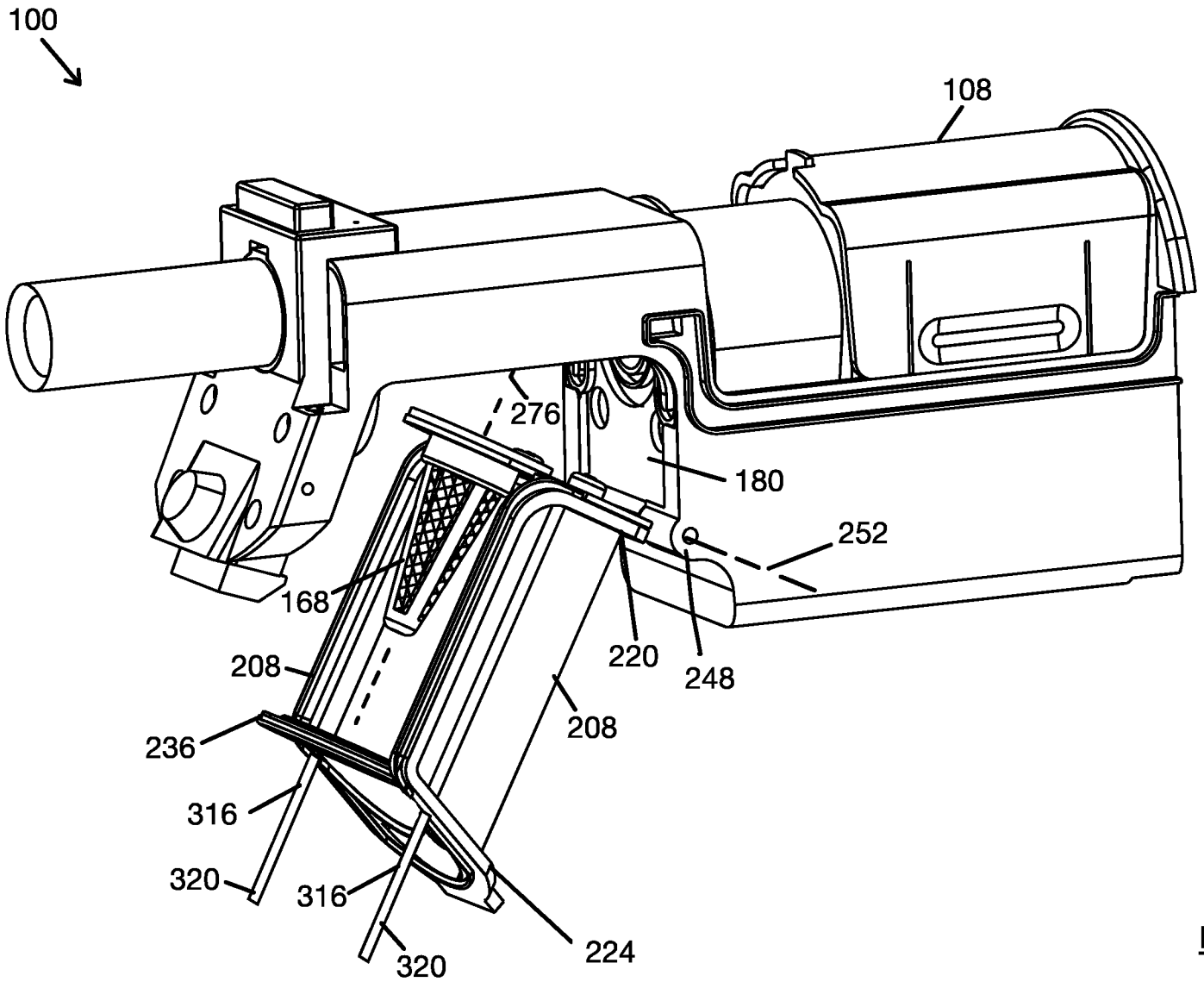
FIG. 18 is a side perspective view of a portion of the hand vacuum cleaner, and showing the cleaning member extended still further into a cleaning position.

Optionally, as best exemplified in FIGS. 15, 16 and 20, each extension rod 316 may be telescopically configured. For example, each rod 318 may comprise a first portion 318 telescopically received within a second portion 320 (e.g., a hollow-interior of the second portion 320). Each portion 318, 320 axially spans between a respective first end 318*a*, 320*a* and a respective second end 318*b*, 320*b*. In the exemplified embodiments, cleaning member 236 is attached to the second portion 320. Optionally, cleaning member 236 is attached near the first end 320*a* of the second portion 320. As exemplified in FIG. 15, the first end of the first portion 318*a*, may be secured (e.g., attached) to the first end 220 of moveable portion 208, so as to anchor the extension rod 316.

Figure 13:
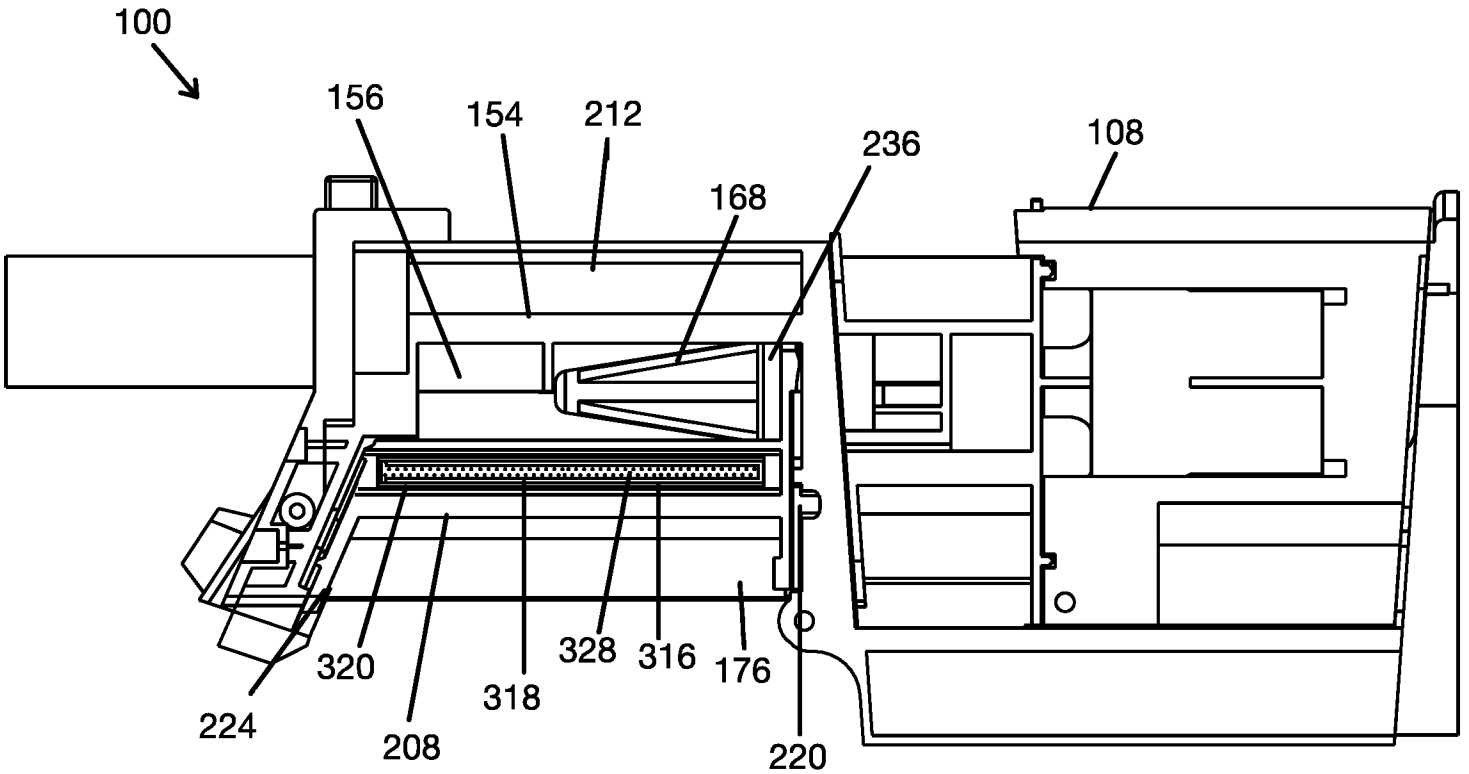
FIG. 13 is a cross-sectional view of a portion of the hand vacuum cleaner, taken along section line 13-13' of FIG. 1.

Optionally, the axial length of the first portion 318 is substantially equal to the axial length of the second portion 320. In this configuration, the first portion 318 is completely nested within the second portion 320 in the operating position (FIG. 13). The second portion 320 may then extend axially outwardly (FIGS. 15-20), along groove 324, to extend away from first portion 318, and to otherwise translate cleaning member 236 to a cleaning position.

Figures 21A, 21B, 21C, 21D:
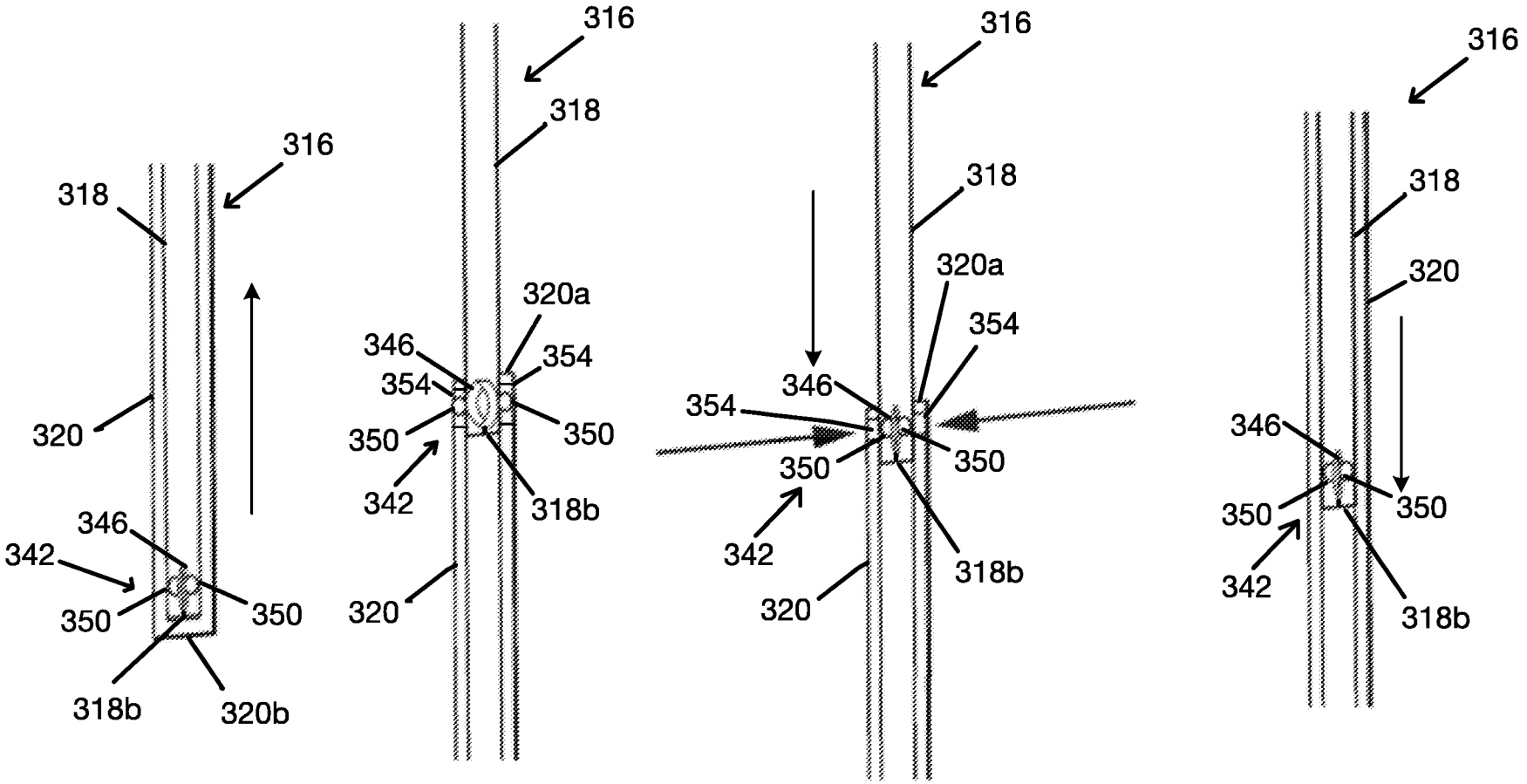
FIGS. 21A-21D show various configurations of a "ball-and-catch" latch mechanism which is used to limit over extension of the cleaning member.
Figure 22:
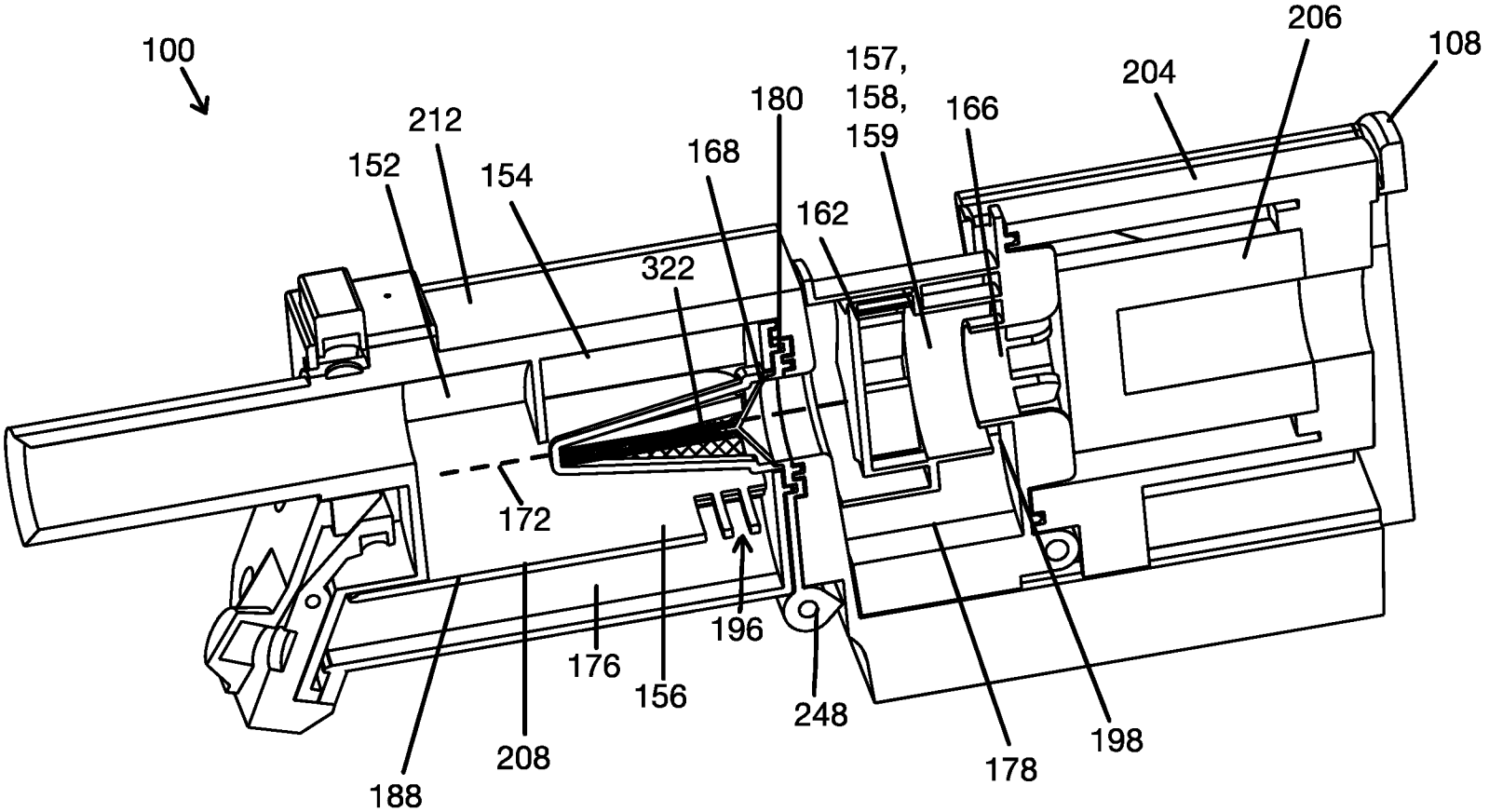
FIG. 22 is a cross-sectional view of a portion of the hand vacuum cleaner of FIG. 1, taken along section line 2-2' of FIG. 1, in accordance with another embodiment.

As exemplified in FIG. 21, to prevent overextension of the second portion 320, relative to the first portion 318, a "ball-and-catch" latch may be provided. The "ball-and-catch" latch may comprise a locking structure 342 disposed inside of the first portion 318, and attached to the second end 318*b* of the first portion 318. As exemplified, the locking structure 342 can comprise one or more spherical members 350 attached to a compressible member 346. The compressible member 346 is biased to an expanded position. FIG. 21A exemplifies the compressible member 346 in the compressed state, in which extension rod 316 is in the operating position. FIG. 21B exemplifies the extension rod 316 in the cleaning position. As exemplified, the second extension portion 320 can include two apertures 354 (e.g., openings) for receiving spherical members 350. Preferably, the apertures 354 are disposed proximal the first end of second portion 320*a*. Once the lock structure 342 is level with apertures 354, the compressible member 346 expands and pushes spherical members 350 into apertures 354. Accordingly, in this configuration, the lock structure 342 prevents further extension of the second portion 320 relative to the first portion 318. As exemplified in FIGS. 21C and 21D, when the extension rod 316 is retracted back into the operating position, the compressible member 346 is compressed, and the spherical members 350 are displaced out of apertures 354. This, in turn, allow the first portion 318 to be telescoped back into the second portion 320. In other embodiments, any other locking structure and/or mechanism can be used for preventing overextension of the second portion 320 relative to the first portion 318.

Any suitable method may also be used to axially translate the cleaning member 236 between the operating position and cleaning position, via extension members 316. For example, a user may manually move cleaning member 236 (and/or second portion 320 of rod 316) into the cleaning position. In such an embodiment, the cleaning member may be provided with a flange or handle to enable manual movement of the cleaning member. This can be done as, or subsequent to, moving sidewall portion 208 into the open position. Alternatively, or in addition, where the top end 136 of the hand vacuum 100 is generally positioned over the lower end 140, the cleaning member 236 may descend into the cleaning position under the influence of gravity. This may also occur as, or subsequent to, moving the sidewall portion 208 in the open position.

Optionally, a biasing mechanism may be provided to bias the cleaning member 236 into the cleaning position. In particular, the biasing mechanism may automatically translate the cleaning member 236 into the cleaning position as, or subsequent to, opening the sidewall portion 208. An advantage of this configuration is that the biasing mechanism allows the cleaning member 236 to automatically wipe dirt and debris from the exterior of the screen 168, without manual intervention from a user.

As exemplified in FIGS. 13, 15, and 20, the biasing mechanism may comprise a secondary biasing spring 328, which is biased to an expanded position. As exemplified, the biasing spring 328 may be provided inside of a hollow interior of the first portion 318 and second portion 320. As exemplified in FIG. 13, in the operating position, the biasing spring 328 is in an initial compressed position. As exemplified in FIGS. 15 and 20, as, or subsequent to, opening the sidewall portion 208, the spring 328 may expand to apply axially opposed forces to the first end of first portion 318*a*, and second end of second portion 320*b*. Accordingly, spring 328 pushes away the second portion 320 from first portion 318. This, in turn, allows the second portion 310 to slide away from the first portion 318, and to move cleaning member 256 into the cleaning position. In other embodiments, any other suitable biasing mechanism may be used for biasing the cleaning member 236 to the cleaning position. In some cases, the biasing mechanism may only bias the cleaning member 236 part way into the cleaning position.

To translate the cleaning member 236 back into the operating position, from the cleaning position, a reverse axial force is applied to the cleaning member 236. In particular, the reverse axial force slides the first portion 318 back within second portion 320. In the operating position, a user may then move (e.g., rotate) the sidewall portion 208 back into the closed position. Alternately, the cleaning member 236 may be locked in the retracted operating position and then the sidewall portion 208 may be rotated into the closed portion.

In alternative embodiments, the biasing spring 328 may be biased in the compressed position, and accordingly, may bias the cleaning member 236 to the operating position.

Referring now to FIGS. 22-25, which exemplify another configuration of the moveable member in which the moveable member comprises at least the screen 168.

Figure 23:
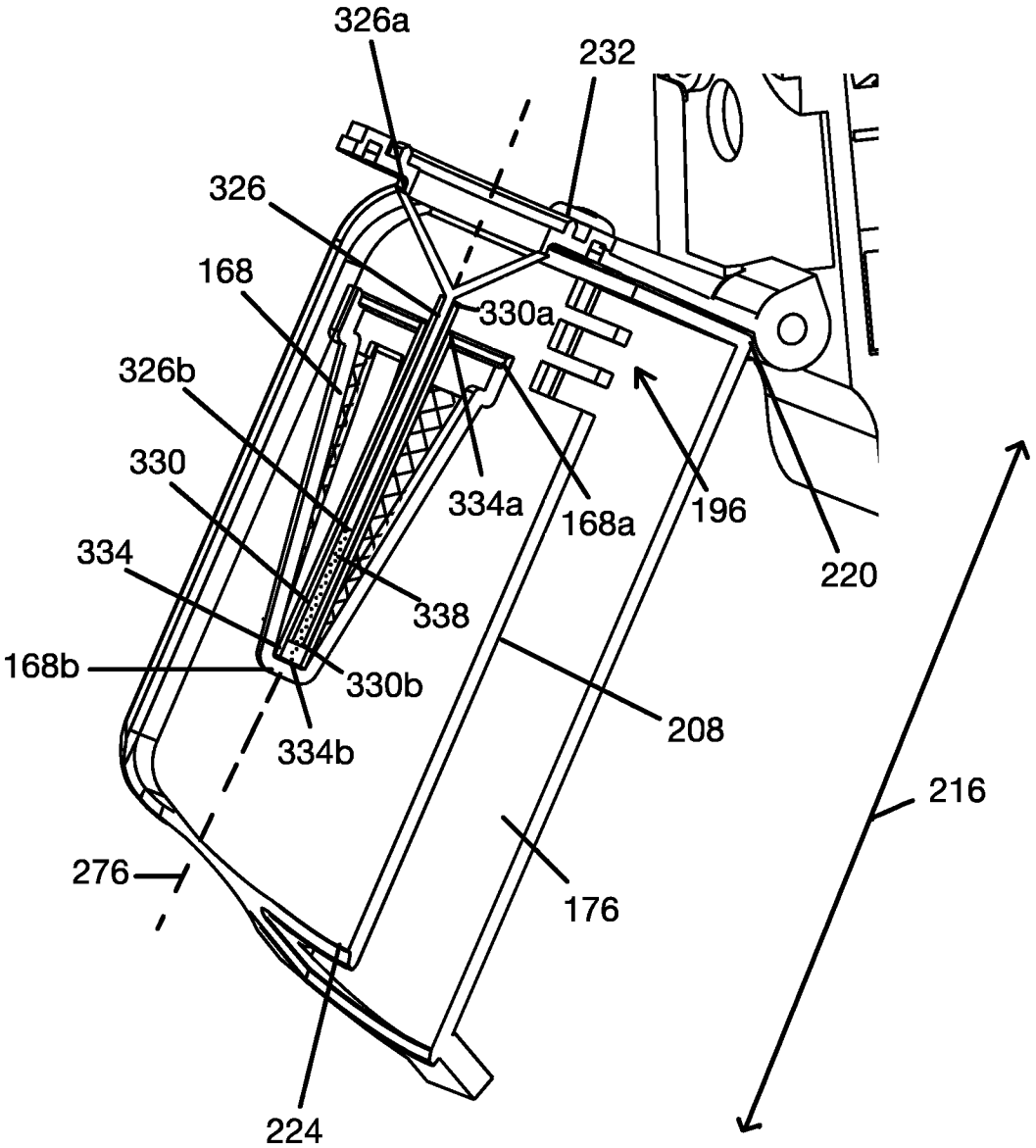
FIG. 23 is an enlarged cross-sectional view of a portion of the hand vacuum cleaner of FIG. 22, taken along section line 2-2' of FIG. 1, and showing the moveable sidewall portion in the open position, and further showing the porous member extended partially into a cleaning position.
Figure 24:
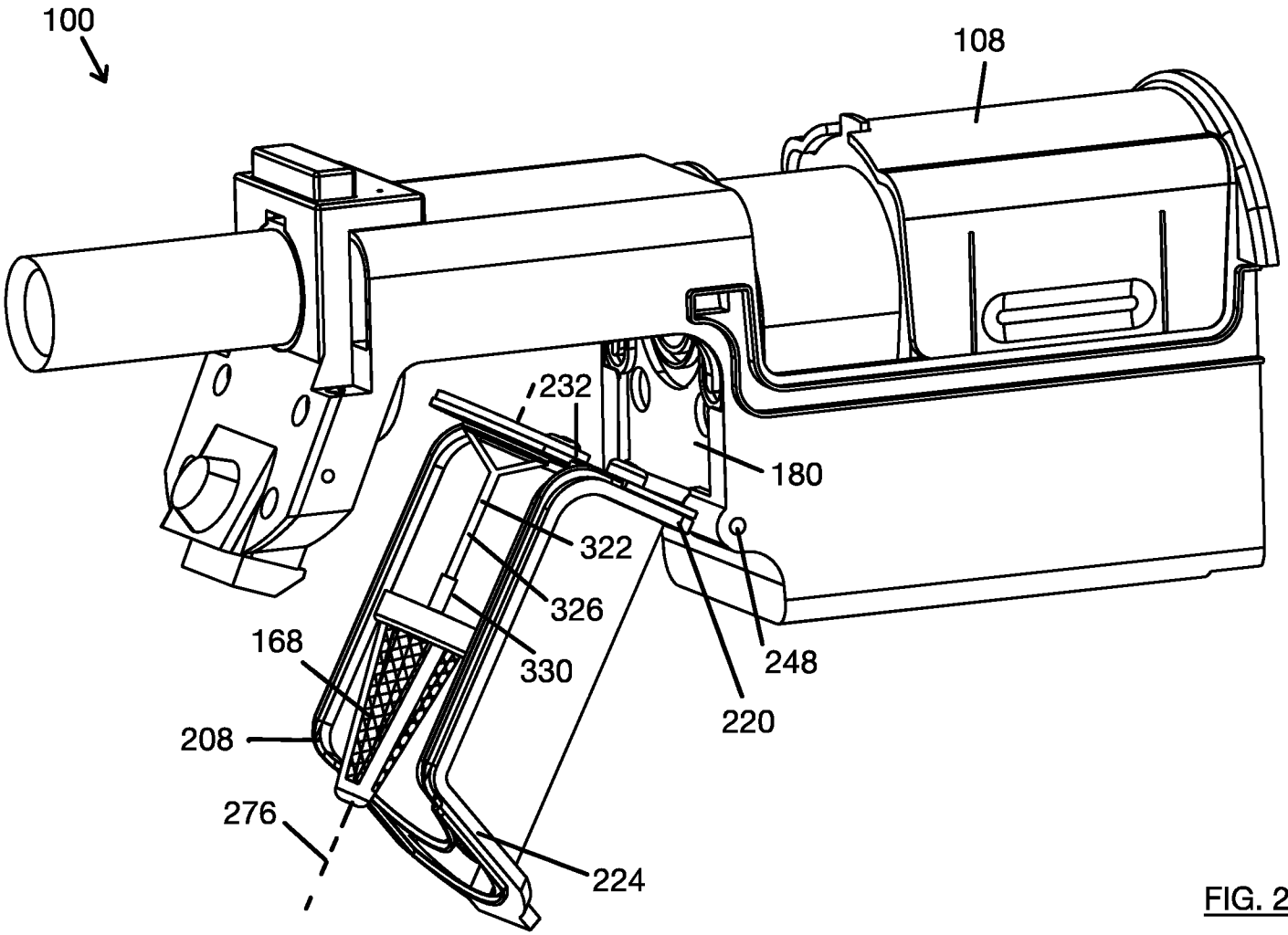
FIG. 24 is a perspective view of a portion of the hand vacuum cleaner of FIG. 22, and showing the porous member extended further into a cleaning position.
Figure 25:
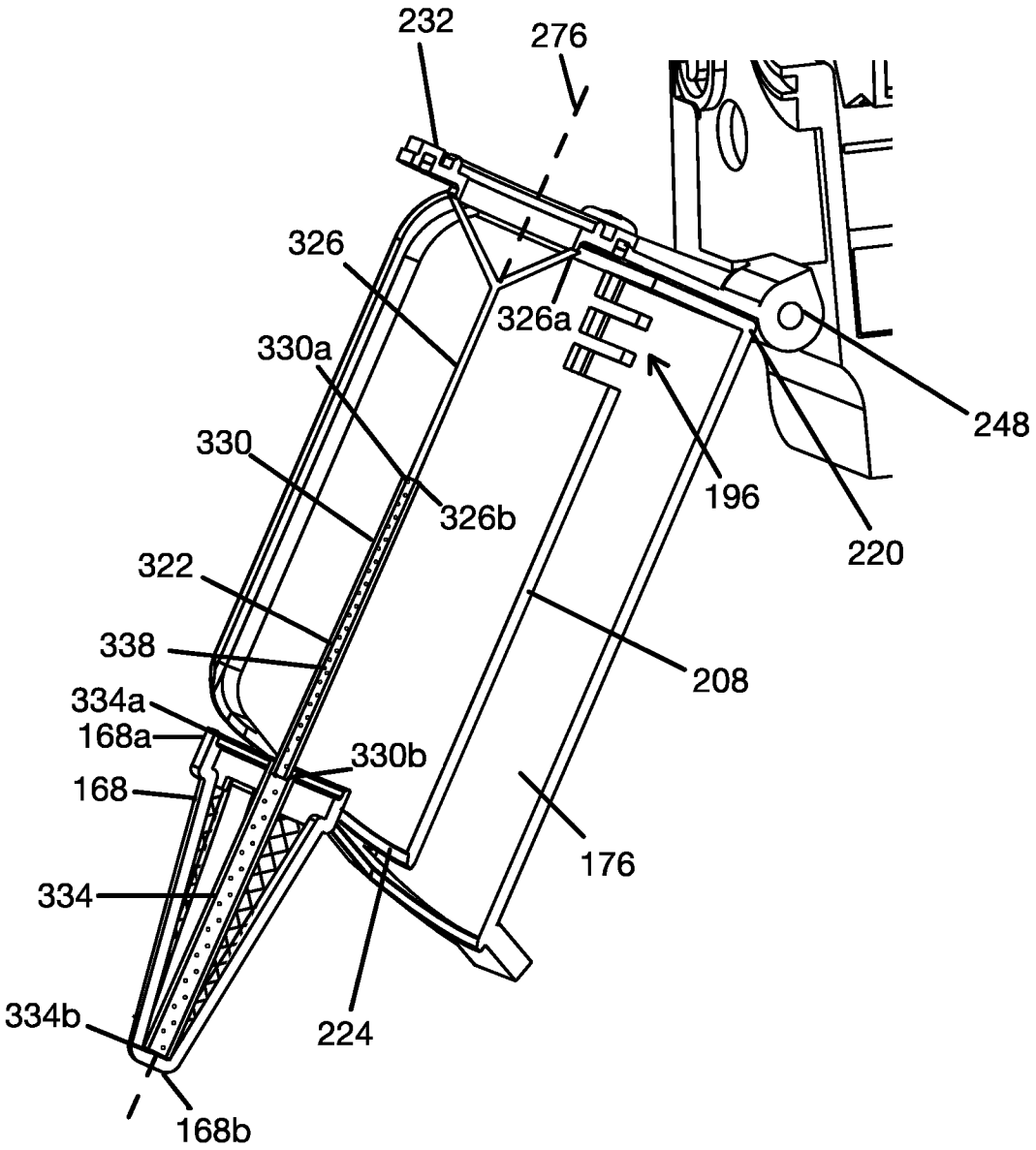
FIG. 25 is an enlarged cross-sectional view of a portion of the hand vacuum cleaner of FIG. 22, taken along section line 2-2' of FIG. 1, and showing the porous member extended still further into a cleaning position.
Figure 26:
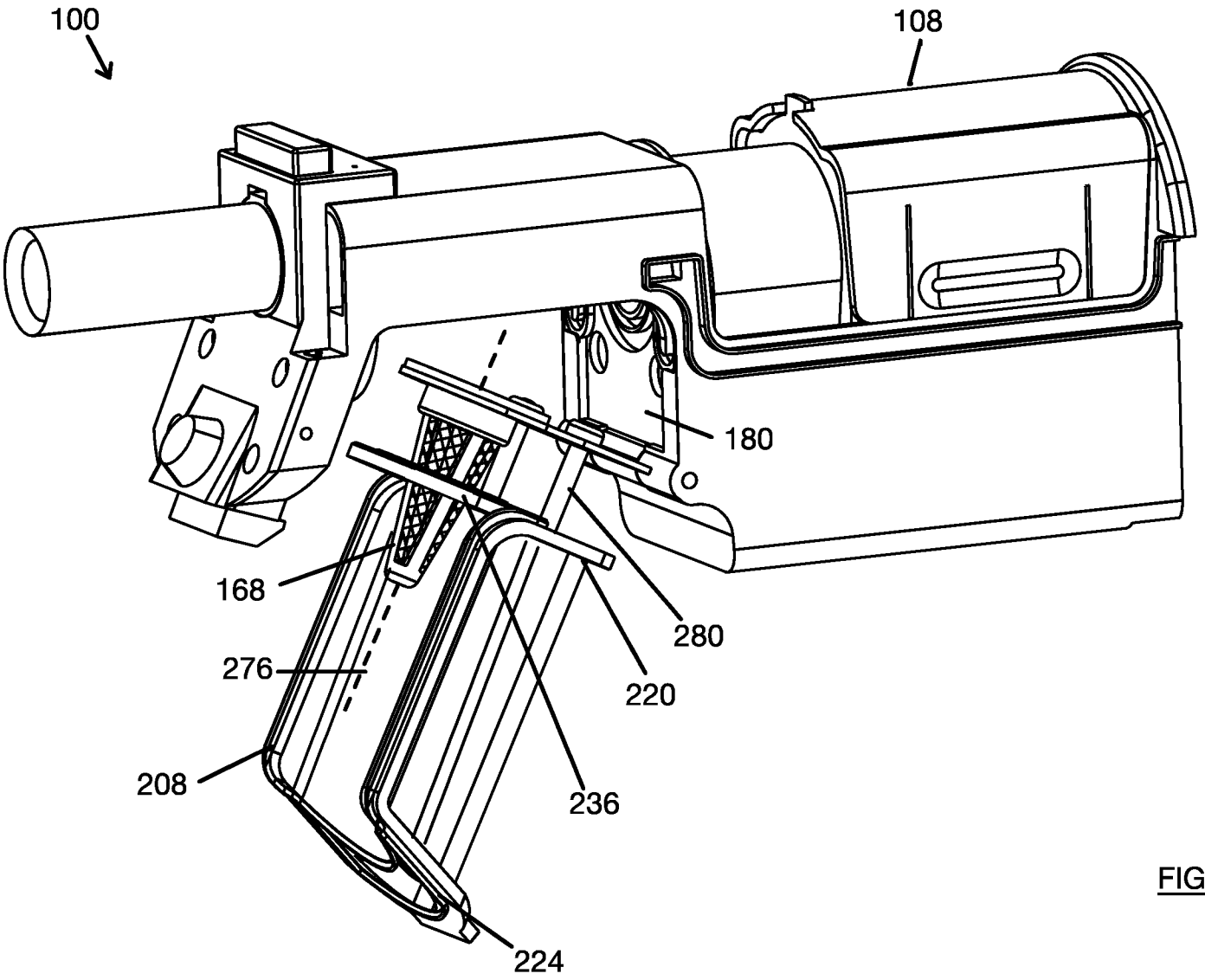
FIG. 26 is a side perspective view of a portion of the hand vacuum cleaner, and showing the sidewall portion in the open position, and further showing the moveable sidewall portion and the cleaning member extended partially into a cleaning position.
Figure 27:
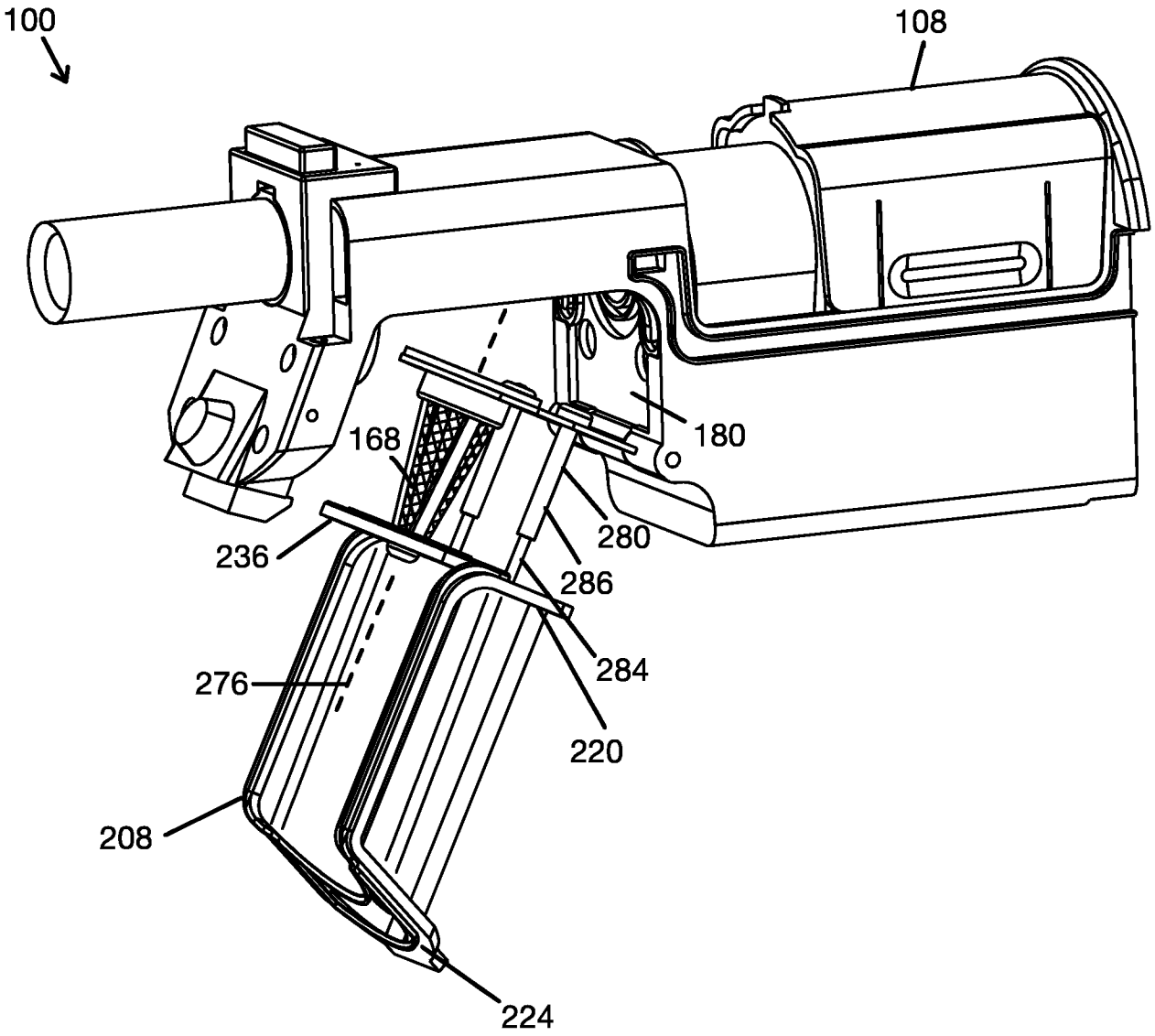
FIG. 27 is a side perspective view of a portion of the hand vacuum cleaner, and showing the moveable sidewall portion and the cleaning member extended further into a cleaning position than is shown in FIG. 26.
Figure 28:
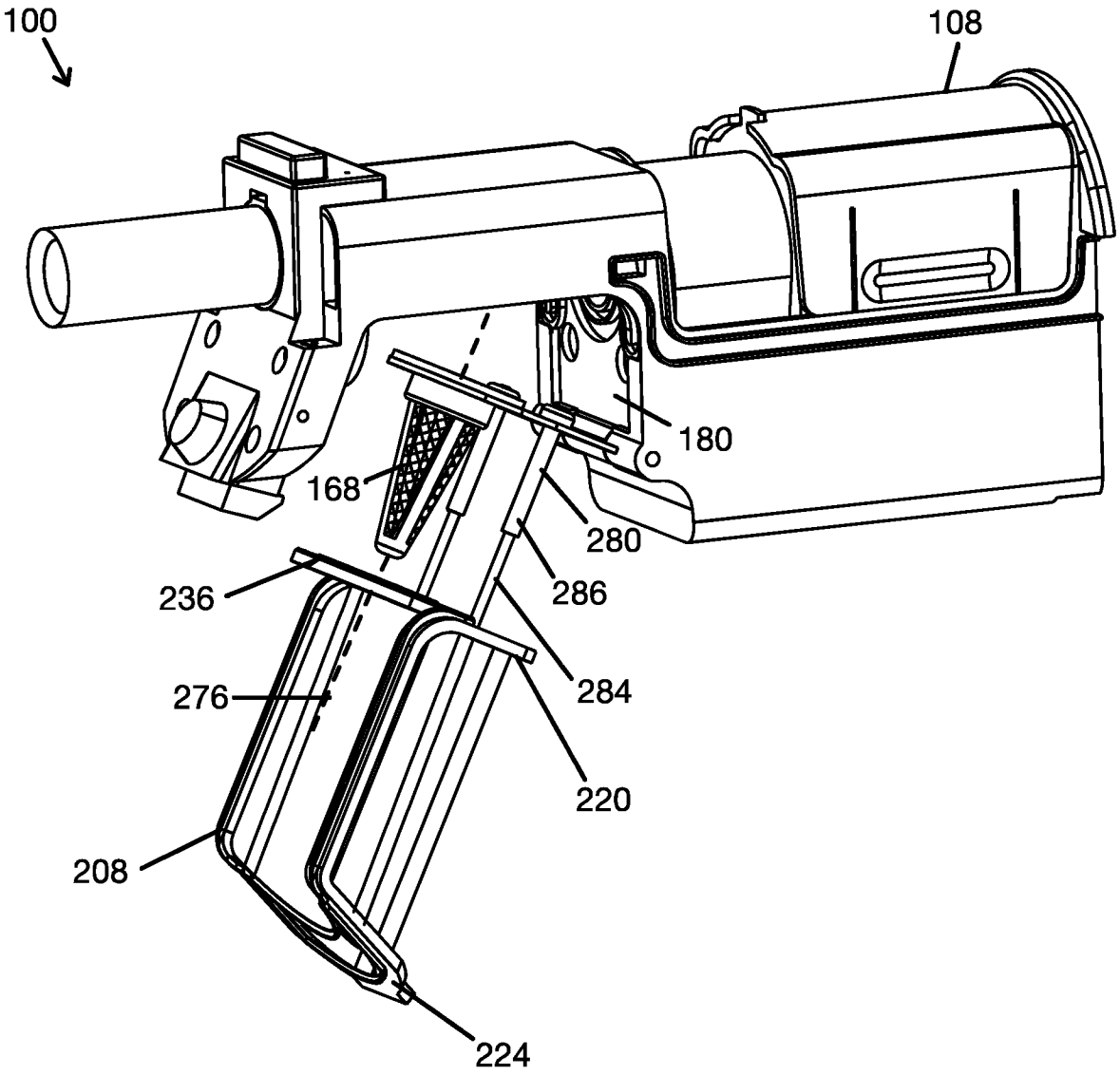
FIG. 28 is a side perspective view of a portion of the hand vacuum cleaner, and showing the moveable sidewall portion and the cleaning member extended still further into a cleaning position than is shown in FIG. 27.
Figure 29:
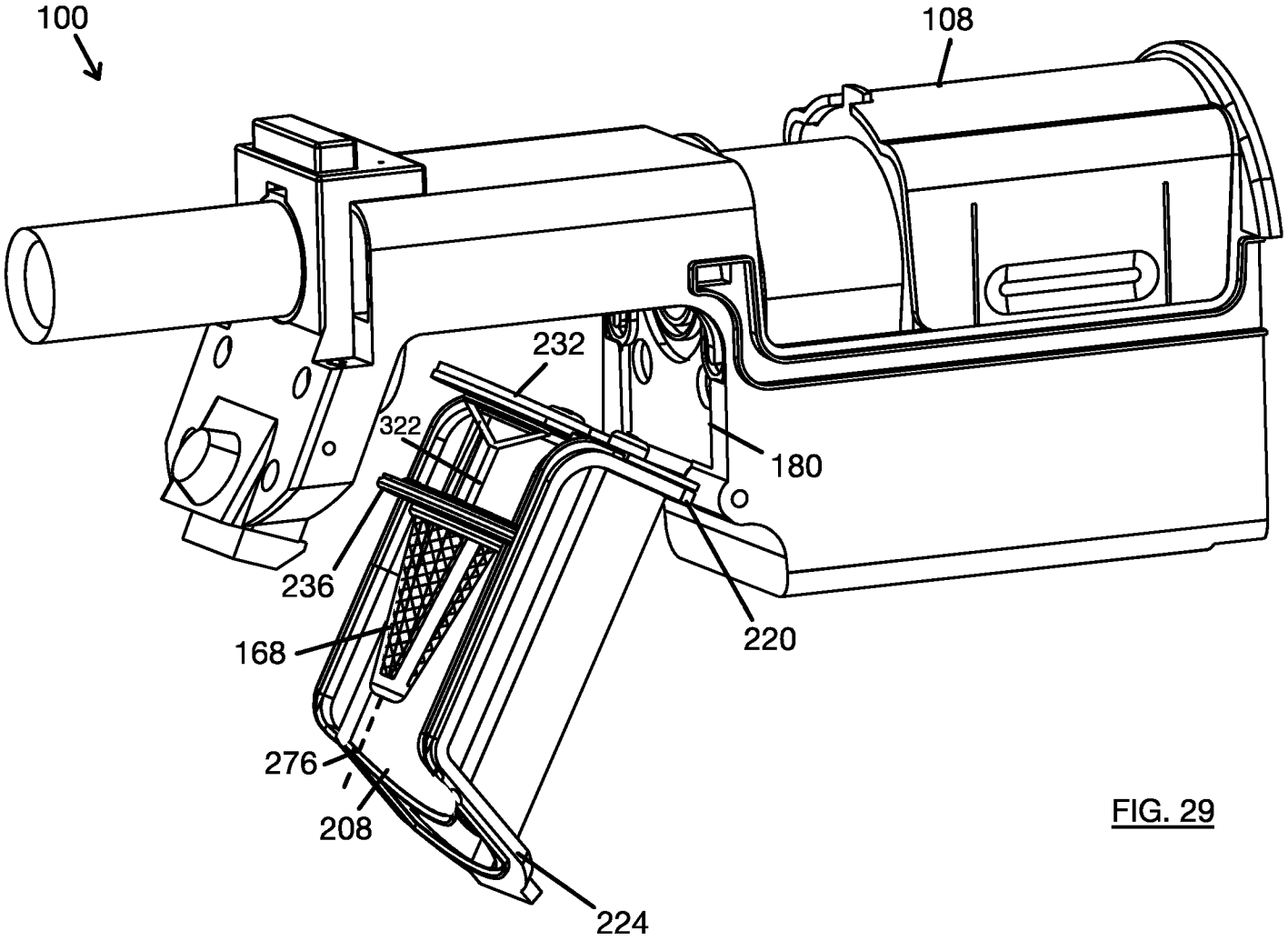
FIG. 29 is a side perspective view of a portion of the hand vacuum cleaner, and showing the cleaning member and the porous member extended partially into a cleaning position, according to one embodiment.
Figure 30:
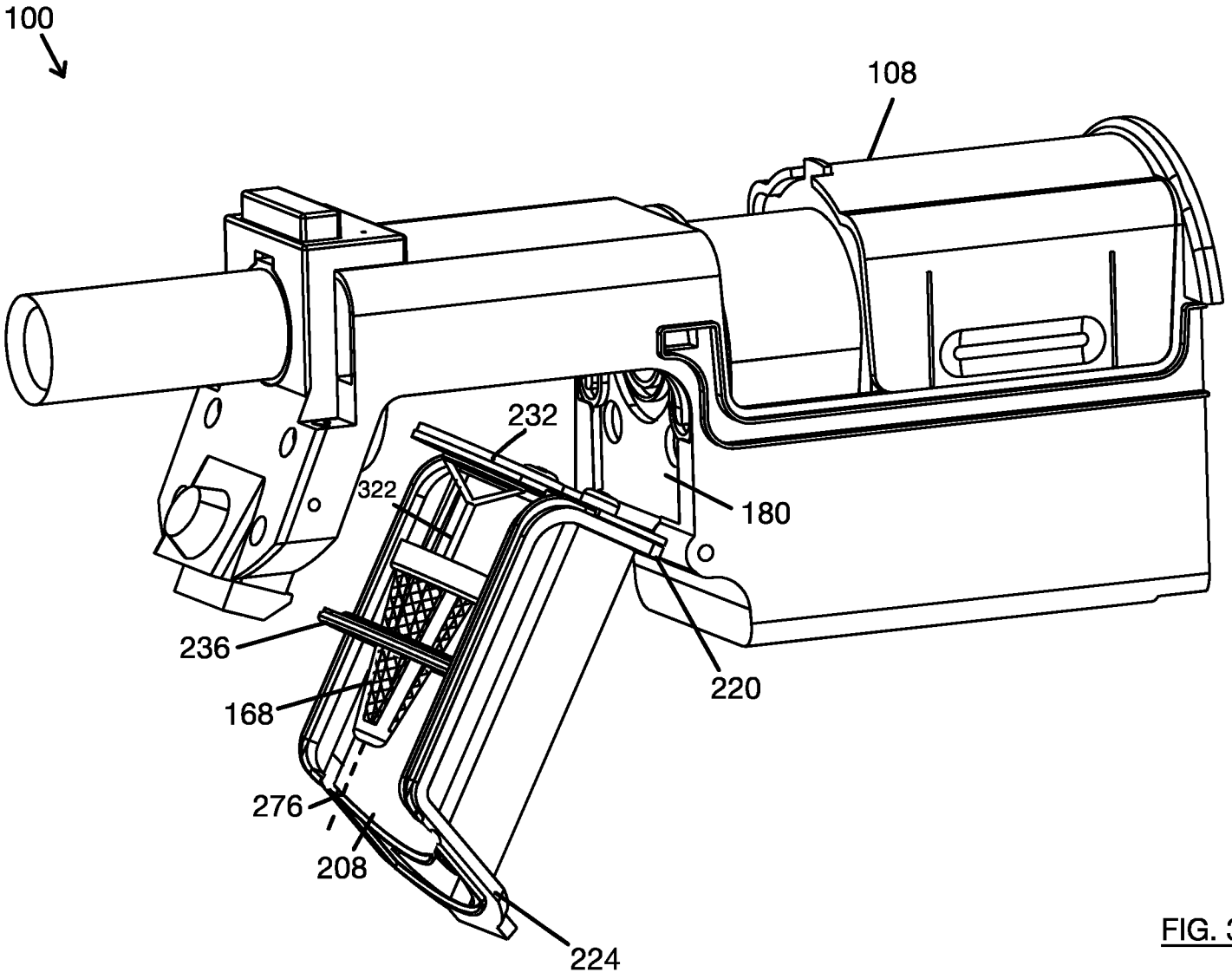
FIG. 30 is a side perspective view of a portion of the hand vacuum cleaner, and showing the porous member in the position of FIG. 29, and showing the cleaning member extended further into a cleaning position
Figure 31:
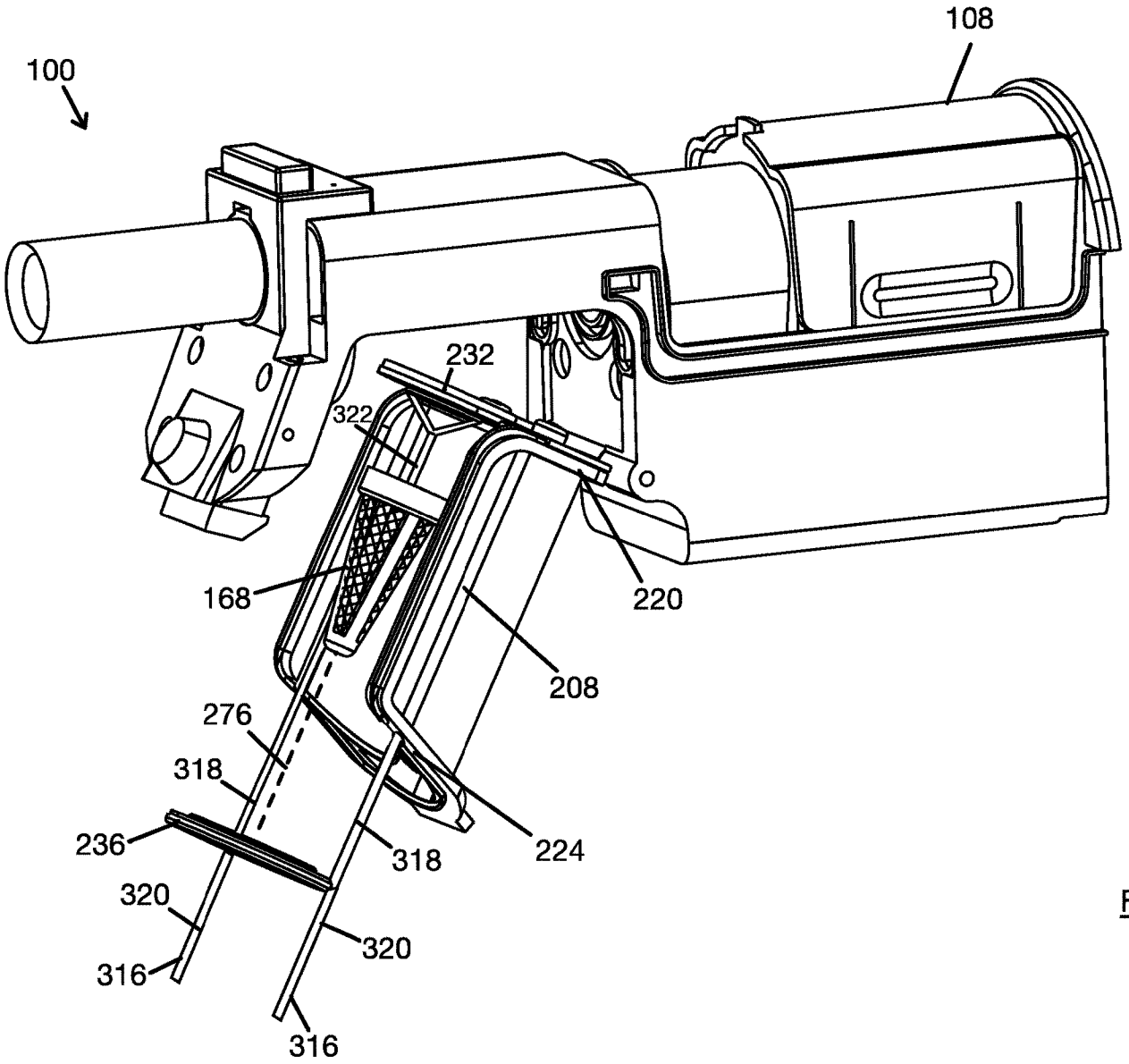
FIG. 31 is a side perspective view of a portion of the hand vacuum cleaner, and showing the porous member in the position of FIG. 29, and showing the cleaning member extended still further into a cleaning position than is shown in FIG. 30.
Figure 32:
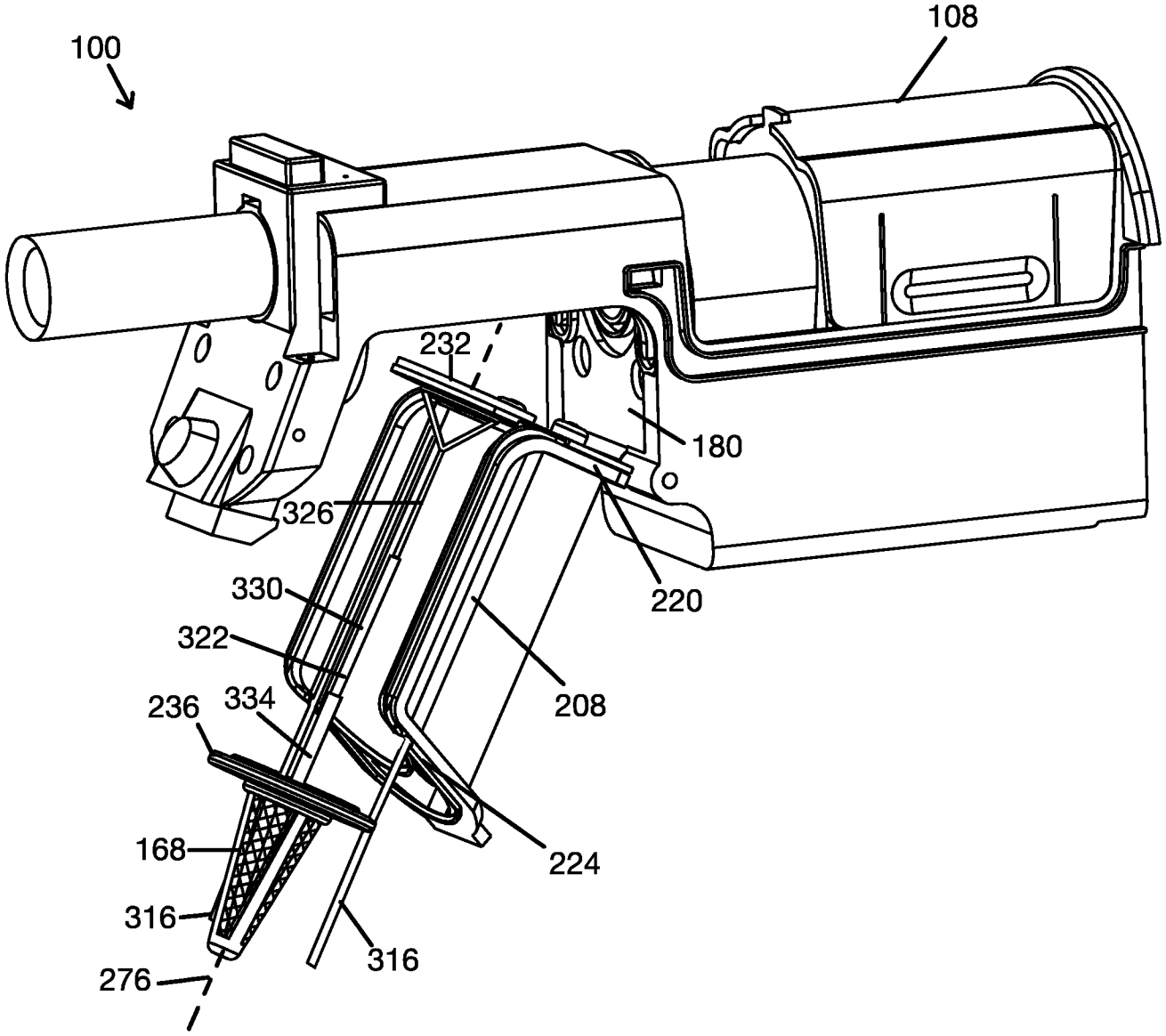
FIG. 32 is a side perspective view of a portion of hand vacuum cleaner, and showing the cleaning member and the porous member extended into a cleaning position, according to another embodiment.
Figure 33:
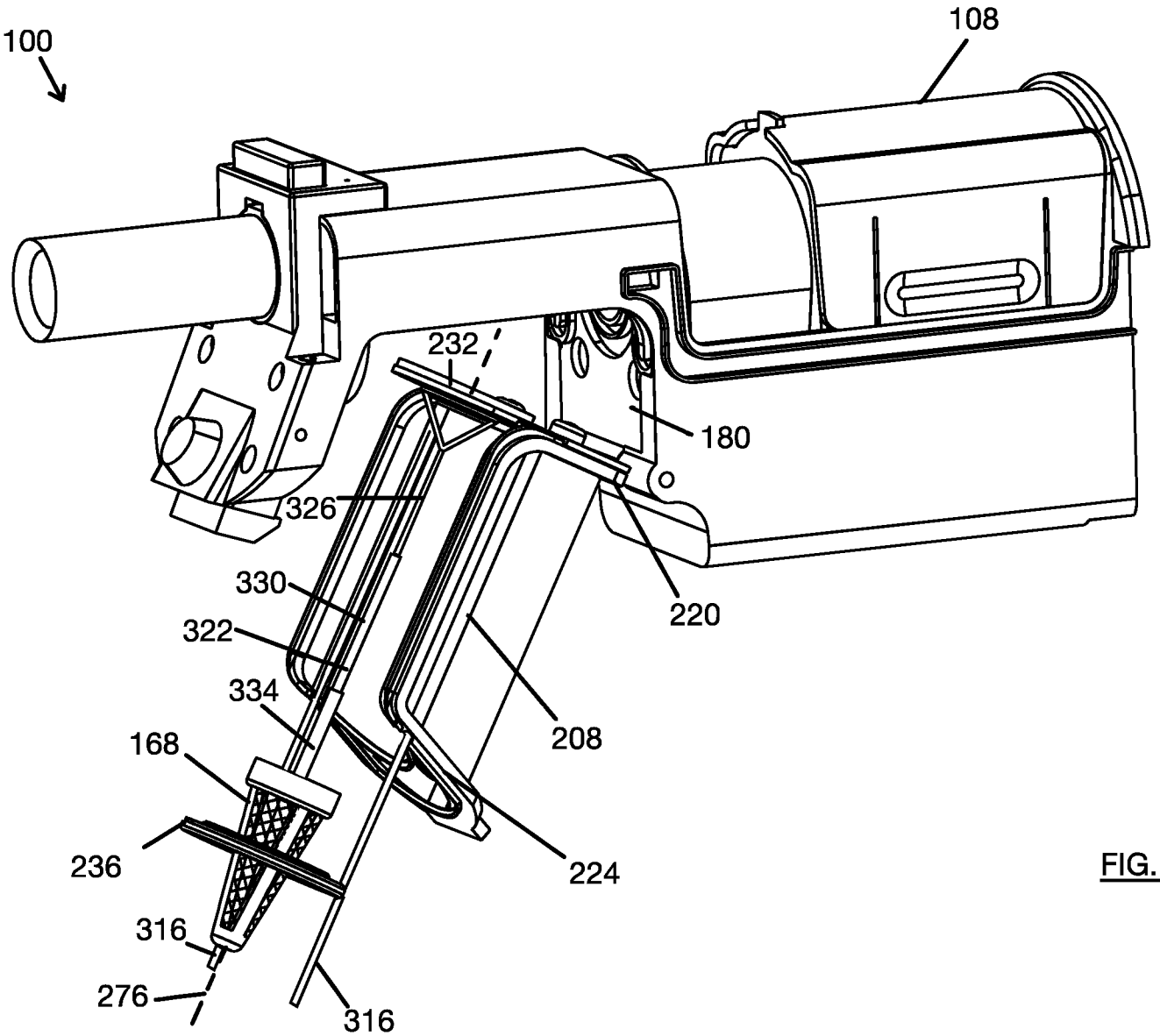
FIG. 33 is a side perspective view of a portion of hand vacuum cleaner, and showing the porous member in the position of FIG. 32, and showing the cleaning member extended further into a cleaning position than is shown in FIG. 32.
Figure 34:
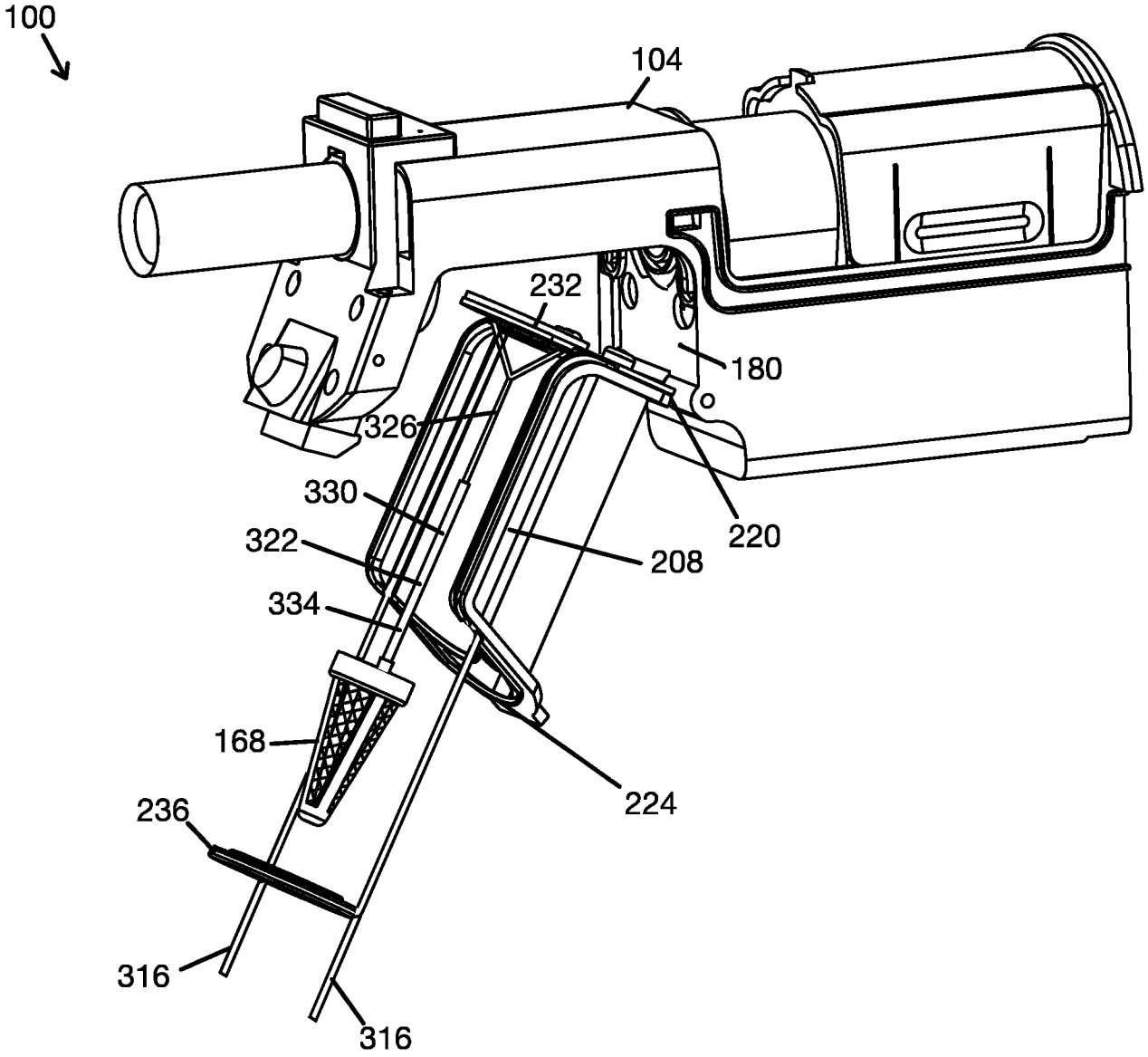
FIG. 34 is a side perspective view of a portion of the hand vacuum cleaner, and showing the porous member in the position of FIG. 32, and showing the cleaning member extended further into a cleaning position than is shown in FIG. 33.

As exemplified, screen 168 may be moveable between an operating position (FIGS. 7 and 22) and one or more cleaning positions (FIGS. 23-25). In the operating position (FIG. 22), the screen 168 is positioned proximal the first cyclone end 180 and/or the back support plate 232. For instance, as exemplified in FIG. 7, the first end of the screen 168*a* may engage (e.g., abut) the back support plate 232. The screen 168 may then axially translate, along translation axis 276, by any variable distance into a cleaning position. For example, screen 168 can translate along the axial length 216 of sidewall portion 208 (FIGS. 23 and 24), to the second 224 of the sidewall portion 208 (FIG. 25), and/or beyond the axial length 216 of the sidewall portion 208 (FIG. 32). An advantage of this configuration is that extending the screen 168 to the cleaning position may facilitate access to the screen (e.g., by a user) to clean the screen exterior from dirt and debris.

Screen 168 may be axially translated between the operating and cleaning positions in any manner known in the art. In the exemplified embodiments (FIG. 23-25), screen 168 is translated using an extendable member 322. As best exemplified in FIGS. 23 and 25, the extendable member 322 may comprise three telescoping segments: first segment 326, second segment 330 and third segment 334. The first segment 326 is telescopically received within the second segment 330, while the second segment 330 is telescopically received within the third segment 334. In other embodiments, any number of telescoping segments may be provided, or alternatively, any other suitable extension mechanism can be used.

As exemplified, each segment axially extends, along axis 276, between a respective first end 326*a*, 330*a*, 334*a* and a respective second end 326*b*, 330*b*, 334*b*. In the exemplified embodiments, the first end of first segment 326*a* is secured to the back support plate 232 (e.g., using a Y-structure member). Similarly, the second end of the third segment 334*b* is attached to screen 168 (e.g., attached to interior second end 168*b* of screen 168).

Preferably, the axial length of each segment 326, 330 and 334 is substantially equal. In this configuration, in the operating position (FIG. 22), the first segment 326 is completely nested within the second segment 330, and the second segment 330 is completely nested within the third segment 334. The screen 168 may then be translated into the cleaning position by telescoping the second segment 330 out of the first segment 326, and telescoping the third segment 334 out of the second segment 326. In various cases, to prevent over-extension of any segment relative to another segment, a stopping mechanism (e.g., a ball-and-catch structure) can be employed between each two sets of segments (e.g., as exemplified in FIG. 21).

The screen 168 may be axially translated, using extendable member 332, in any suitable manner between the operating and cleaning positions. For example, a user may pull the screen 168 and/or the extendable member 332 and/or a flange or handle attached thereto axially outwardly as, or subsequent to, moving the sidewall portion 208 in the open position. Alternatively, or in addition, the screen 168 may descend under the force of gravity into the cleaning position as, or subsequent to, moving the sidewall portion 208 in the open position (e.g., assuming the top end 140 of the surface cleaning apparatus is positioned on top of the lower end 140).

Optionally, a biasing mechanism may be provided to bias the screen 168 into the cleaning position. For example, the biasing mechanism may bias the screen 168 into the cleaning position as, or subsequent to, the sidewall portion 208 being opened. An advantage of this configuration is that the biasing mechanism may automatically move the screen 168 axially outwardly into the cleaning position without manual intervention by a user.

In the exemplified embodiments (e.g., FIGS. 23 and 25), the biasing mechanism comprises a biasing spring 338, biased to an expanded position. As exemplified, the biasing spring 338 may be disposed inside of a hollow interior of the second segment 330 and third segment 334. As partially exemplified in FIG. 23, in the operating position, the biasing spring 338 is in an initial compressed position. As exemplified in FIG. 25, as, or subsequent to, opening the sidewall portion 208, the spring 338 may expand. In particular, as the spring 338 expands, spring 338 may apply axially opposed forces to the second end of the first segment 326*b*, and the second end of the third segment 334*b*. Accordingly, spring 328 pushes away the first segment 326 from the third segment 334, and in turn, translates screen 168 into the cleaning position. In other embodiments, any other suitable biasing mechanism can be used for biasing the screen 168 in the cleaning position. In some cases, the biasing mechanism may only bias the screen 168 part way into the cleaning positions. Alternatively, in other embodiments, the biasing spring 328 may be biased in the compressed position, and accordingly, can bias the cleaning member 236 in the operating position.

To translate the screen 168 back into the operating position, a reverse axial force may be applied to the screen 168 and/or the extendable member 322. The axial force may counter the biasing force of the spring 338. Once the screen 168 is returned to the operation position, a user may move (e.g., pivot) the sidewall portion 208 back into the closed position. Alternately, the screen 168 may be locked in the retracted operating position and then the sidewall portion 208 may be rotated into the closed portion.

Figure 35:
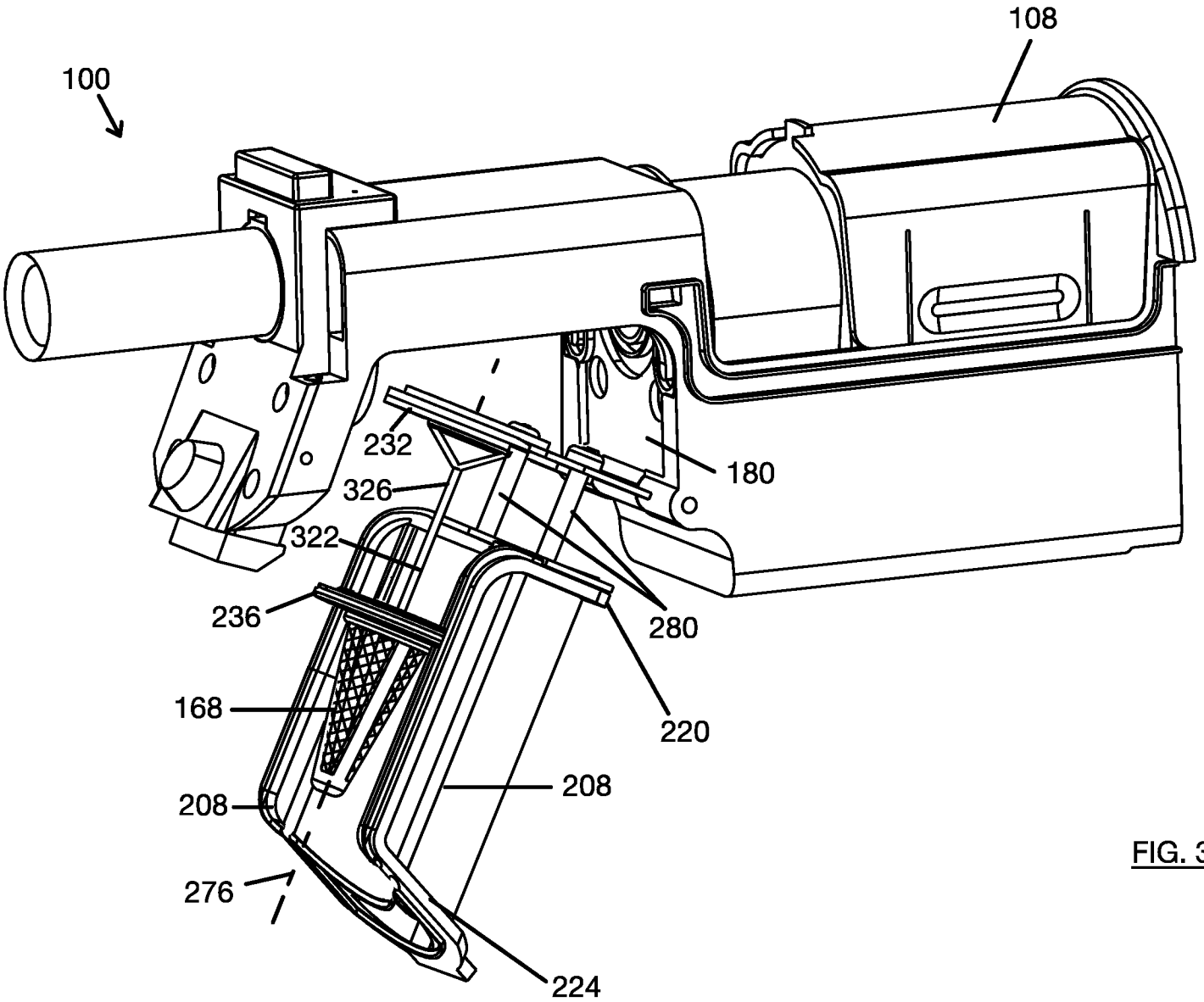
FIG. 35 is a side perspective view of a portion of the hand vacuum cleaner, and showing the sidewall portion extended into a cleaning position, and showing the porous member and the cleaning member extended further into a cleaning position.
Figure 36:
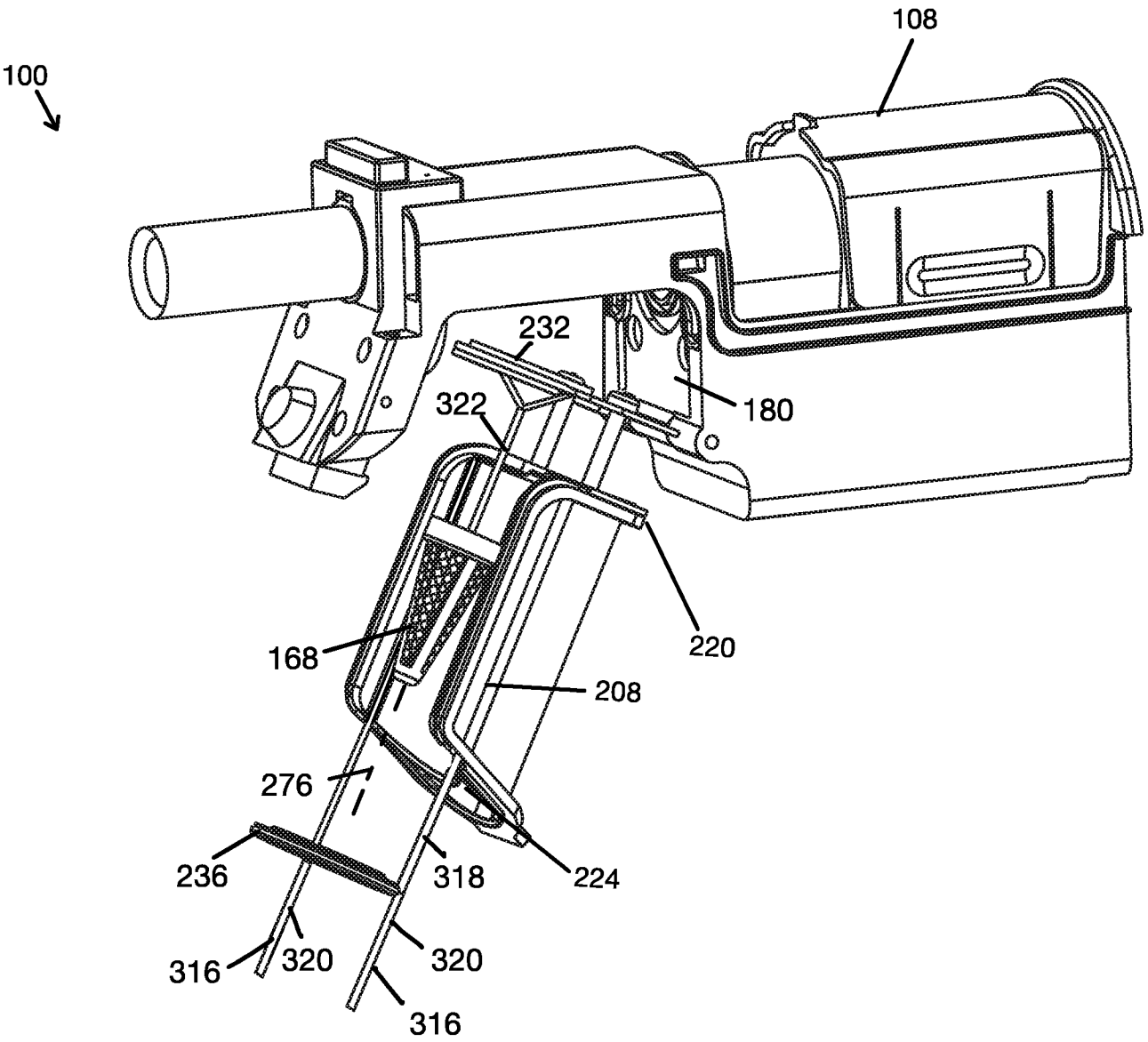
FIG. 36 is a side perspective view of a portion of the hand vacuum cleaner, and showing the sidewall portion and cleaning member in the position of FIG. 35, and showing the cleaning member extended still further into the cleaning position than is shown in FIG. 35.

Referring now to FIGS. 26-36, as exemplified, in some configurations, the moveable member may comprise any combination of the sidewall portion 208, cleaning member 236 and screen 168. For example, as exemplified, the moveable member may comprise the combination of the sidewall portion 208 and cleaning member 236 (FIGS. 26-28), the screen 168 and cleaning member 236 (FIGS. 29-34), or the combination of each of the sidewall portion 208, screen 168 and cleaning member 236 (FIGS. 35-36).

In some embodiments, where the moveable member comprises more than one element, the elements may be translated concurrently. For example, as exemplified in FIGS. 26-28, the sidewall portion 208 and cleaning member 236 may move concurrently into a cleaning position. In the exemplified embodiment, the cleaning member 236 is fixed at the first end 220 of the moveable portion 220 such that cleaning member 236 moves concurrently with the sidewall portion 208. An advantage of this configuration is that movement of the sidewall portion 208 may result in cleaning of screen 168 by cleaning member 236.

In other embodiments, elements may move concurrently part-way, before moving separately. For example, as exemplified in FIGS. 29 and 32, screen 168 and cleaning member 236 may move concurrently part-way along the axial length of sidewall portion 208 (FIG. 29), or beyond the axial length of sidewall portion 208 (FIG. 32). The screen 168 may then be secured (e.g., held) in position, while the cleaning member 236 is translated, separately, further into the cleaning position (FIGS. 30, 31, 33 and 34) to wipe the screen 168.

In still other embodiments, rather than moving concurrently, elements can be moved sequentially. For instance, in FIGS. 29 and 32, the screen 168 may be translated outwardly first, and the cleaning member 236 may be translated outwardly after the screen 168 (or vice-versa), to achieve the exemplified configuration. Similarly, as exemplified FIGS. 35-36, the sidewall portion 208 may be moved outwardly first, before moving the cleaning member 236 and/or screen 168.

In still yet other embodiments, one or more elements may be translated using biasing mechanisms (e.g., biasing springs), as described herein. In embodiments where more than one element is biased in the cleaning position, the elements may be biased to move into the cleaning position at identical rates, or at different rates. For example, biasing springs 230, 308, 338—used for moving the sidewall portion 208, cleaning member 236 and screen 168, respectively—may have similar spring constants. Accordingly, biasing springs may translate their respective elements into the cleaning position at similar rates. For example, the screen and cleaning member may be biased to extend outwardly, at a similar rate, as, or subsequent to, opening the moveable portion 208. In particular, this may be possible where the biasing spring 308 of cleaning member 236 has a similar spring coefficient as biasing spring 338 of screen 168. In other cases, the biasing mechanisms can move elements at different rates. For example, different biasing springs may have different spring coefficients. For instance, in FIGS. 29 and 31, the biasing spring 308 may extend cleaning member 236 into the cleaning position at a faster rate than the biasing spring 338 used for screen 168. In this manner, the cleaning member 236 translates outwardly faster than the screen 168, so as to wipe the screen 168 from dirt and debris.

Alternately, or in addition, different biasing mechanisms may push different elements outwardly by different maximum extents. For instance, different biasing springs may have different maximum extensions. For example, in FIGS. 35-36, the biasing mechanism used for moving the cleaning member 236 may push the cleaning member 236 further outwardly than the screen 168. Similarly, the biasing mechanism used for screen 168 may push screen 168 further outwardly than sidewall portion 208.

In view of the foregoing, it will be appreciated that any combination of elements may comprise the moveable member, and the moveable elements may be translated, with respect to one another, from the operating position to the cleaning position in any suitable manner.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A hand vacuum cleaner having an upper end, a lower end, a front end, a rear end, a handle and first and second laterally opposed sides, each laterally opposed side extends in a forward/rearward direction, the hand vacuum cleaner comprising:

(a) an air flow path extending from a dirty air inlet provided at the front end of the hand vacuum cleaner to a clean air outlet positioned rearward of the dirty air inlet;

(b) a suction motor positioned in the air flow path upstream of the clean air outlet; and, (c) an air treatment member positioned in the air flow path, the air treatment member comprising an air treatment chamber and a dirt collection chamber exterior to the air treatment chamber, the air treatment chamber having a front end, a rearwardly disposed rear end, a sidewall extending between the front end of the air treatment chamber and the rear end of the air treatment chamber, an air treatment chamber air inlet and an air treatment chamber air outlet, the air outlet provided at the rear end of the air treatment chamber, the air treatment member comprises a stationary portion and an openable portion, the openable portion comprises a portion of the sidewall and the openable portion is moveably mounted by a mount between a closed position in which the air treatment chamber and the dirt collection chamber are closed and an open position in which the air treatment chamber and the dirt collection chamber are open, wherein the air flow path includes an inlet conduit extending rearwardly from the dirt air inlet to the air treatment chamber and the inlet conduit is provided at the upper end of the hand vacuum cleaner, and wherein, when the inlet conduit extends generally horizontally, the dirt collection chamber underlies the air treatment chamber.

2. The hand vacuum cleaner of claim 1 wherein the dirt collection chamber is in communication with the air treatment chamber via a dirt outlet and the dirt outlet comprises a slot provided in a portion of a wall of the air treatment chamber and the portion of the wall is part of the openable portion.

3. The hand vacuum cleaner of claim 1 wherein, when the inlet conduit extends generally horizontally, the openable portion is provided at the lower end of the hand vacuum cleaner.

4. The hand vacuum cleaner of claim 3, wherein the openable portion forms a portion of an exterior surface of the hand vacuum cleaner.

5. The hand vacuum cleaner of claim 1 wherein, when the openable portion is in the closed position, the openable portion and the stationery portion abut along peripheral edges that extend in the forward/rearward direction.

6. The hand vacuum cleaner of claim 5 wherein, when the inlet conduit extends generally horizontally, the peripheral edges extend generally horizontally.

7. The hand vacuum cleaner of claim 5 wherein the peripheral edges extend forwardly from the mount.

8. The hand vacuum cleaner of claim 7 wherein the mount is located rearward of the air treatment chamber air outlet.

9. The hand vacuum cleaner of claim 1 wherein the mount comprises a rotational mount.

10. The hand vacuum cleaner of claim 1 wherein the dirt collection chamber extends forwardly underneath the air treatment chamber from the rear end of the air treatment chamber.

11. The hand vacuum cleaner of claim 1, wherein each of the air treatment chamber and the dirt collection chamber have a rear end located at the mount and each of the air treatment chamber and the dirt collection chamber extend forwardly from the mount.

12. The hand vacuum cleaner of claim 1, wherein the dirt collection chamber has a front end that is opened when the openable portion is moved to the open position.

13. A hand vacuum cleaner having a front end, a rear end, an upper end, a lower end and opposed outer sides that extend in a forward/rearward direction between the upper end and the lower end, the hand vacuum cleaner comprising:

(a) an air flow path extending from a dirty air inlet provided at a front end of the hand vacuum cleaner to a clean air outlet positioned rearward of the dirty air inlet;

(b) a suction motor positioned in the air flow path upstream of the clean air outlet; and, (c) an air treatment member positioned in the air flow path, the air treatment member comprising an air treatment chamber and a dirt collection chamber exterior to the air treatment chamber, the air treatment chamber having an air treatment chamber air inlet and an air treatment chamber air outlet, the air treatment chamber air outlet provided at the rear end of the air treatment chamber, the dirt collection chamber having an outer wall which forms part of the lower end of the hand vacuum cleaner, the air treatment member comprises a stationary portion and an openable portion, the openable portion comprises the outer wall, the openable portion is moveably mounted by a mount between a closed position in which the air treatment chamber and the dirt collection chamber are closed and an open position in which the air treatment chamber and the dirt collection chamber are open, wherein the mount is located at a rear end of the air treatment chamber.

14. The hand vacuum cleaner of claim 13 wherein the outer wall comprises a portion of the opposed outer sides and the outer wall is generally U-shaped in a plane transverse to the forward/rearward direction.

15. The hand vacuum cleaner of claim 13 further comprising an inlet conduit extending rearwardly from the dirty air inlet to the air treatment chamber, the inlet conduit is provided at an upper end of the hand vacuum cleaner.

16. The hand vacuum cleaner of claim 13 wherein, when the openable portion is in the closed position, the openable portion and the stationery portion abut along peripheral edges that extend in the forward/rearward direction.

17. The hand vacuum cleaner of claim 16 further comprising an inlet conduit extending rearwardly from the dirty air inlet to the air treatment chamber, the inlet conduit is provided at an upper end of the hand vacuum cleaner and, when the inlet conduit extends generally horizontally, the peripheral edges extend generally horizontally.

18. The hand vacuum cleaner of claim 13 wherein the dirt collection chamber has a rear end located at the mount and each of the air treatment chamber and the dirt collection chamber extend forwardly from the mount.

19. The hand vacuum cleaner of claim 1 wherein the air treatment member comprises a first cyclonic cleaning stage and a second cyclonic cleaning stage.

20. The hand vacuum cleaner of claim 13 wherein the air treatment member comprises a first cyclonic cleaning stage and a second cyclonic cleaning stage.

* * * * *